US009657955B2

(12) United States Patent
Yamashita et al.

(10) Patent No.: US 9,657,955 B2
(45) Date of Patent: May 23, 2017

(54) AIR-CONDITIONING APPARATUS

(75) Inventors: Koji Yamashita, Tokyo (JP); Hiroyuki Morimoto, Tokyo (JP); Yuji Motomura, Tokyo (JP); Takeshi Hatomura, Tokyo (JP); Naoki Tanaka, Tokyo (JP); Shinichi Wakamoto, Tokyo (JP); Takashi Okazaki, Tokyo (JP); Yusuke Shimazu, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 744 days.

(21) Appl. No.: 13/056,390

(22) PCT Filed: Oct. 29, 2008

(86) PCT No.: PCT/JP2008/069602

§ 371 (c)(1),
(2), (4) Date: Jun. 7, 2011

(87) PCT Pub. No.: WO2010/050000

PCT Pub. Date: May 6, 2010

(65) Prior Publication Data

US 2011/0225998 A1 Sep. 22, 2011

(51) Int. Cl.
*F25B 5/00* (2006.01)
*F24F 3/06* (2006.01)
(Continued)

(52) U.S. Cl.
CPC ..... *F24F 3/065* (2013.01); *F24F 11/008* (2013.01); *F25B 13/00* (2013.01); *F25B 25/005* (2013.01);
(Continued)

(58) Field of Classification Search
CPC ..... F24F 3/065; F25B 13/00; F25B 25/005; F25B 2339/047; F25B 2313/0231
(Continued)

(56) References Cited

U.S. PATENT DOCUMENTS 4,390,058 A * 6/1983 Otake et al. ..... 165/11.1
6,405,551 B1 6/2002 Kuwabara et al.
(Continued)

FOREIGN PATENT DOCUMENTS

CN 1825008 8/2006
ES 2 263 397 A1 12/2006
(Continued)

OTHER PUBLICATIONS

Takashi et al., Refrigeration Cycle System, Dec. 3, 2003, JP2003343936A, Whole Document.*
(Continued)

*Primary Examiner* — Larry Furdge
(74) *Attorney, Agent, or Firm* — Buchanan Ingersoll & Rooney PC

(57) ABSTRACT

To obtain an air-conditioning apparatus that does not make a refrigerant circulate up to an indoor unit and further can achieve energy-saving. A refrigeration cycle is configured by connecting a compressor that pressurizes a refrigerant, a four-way valve that switches a circulation path of the refrigerant, a heat source side heat exchanger that performs heat exchange, expansion valves for pressure-adjusting the refrigerant, and a plurality of intermediate heat exchangers that performs heat exchange between the refrigerant and the heat medium to heat and cool the heat medium, with piping. A heat medium circuit is configured by connecting intermediate heat exchangers, pumps that pressurize the heat medium, and a plurality of use side heat exchangers that
(Continued)

perform heat exchange between the heat medium and the air in the indoor space, with piping.

4 Claims, 11 Drawing Sheets

(51) Int. Cl.
*F24F 11/00* (2006.01)
*F25B 25/00* (2006.01)
*F25B 13/00* (2006.01)

(52) U.S. Cl.
CPC ... *F25B 2313/003* (2013.01); *F25B 2313/006* (2013.01); *F25B 2313/0231* (2013.01); *F25B 2313/0233* (2013.01); *F25B 2313/02741* (2013.01); *F25B 2339/047* (2013.01)

(58) Field of Classification Search
USPC ..... 62/160, 175, 196.1, 200, 201, 332, 335, 62/467; 165/208
See application file for complete search history.

(56) References Cited

U.S. PATENT DOCUMENTS

| | | | | |
|---|---|---|---|---|
| 2006/0191286 | A1* | 8/2006 | Park et al. | 62/434 |
| 2007/0180844 | A1* | 8/2007 | Fujiyoshi et al. | 62/271 |

FOREIGN PATENT DOCUMENTS

| | | | | | |
|---|---|---|---|---|---|
| JP | 5-280818 | A | | 10/1993 | |
| JP | 2003-343936 | A | | 12/2003 | |
| JP | 2003343936 | A | * | 12/2003 | |
| JP | 2004-053069 | A | | 2/2004 | |
| JP | 2004044948 | A | * | 2/2004 | F24F 11/02 |
| JP | 2004053069 | | * | 2/2004 | F25B 1/00 |
| JP | 2004-257586 | A | | 9/2004 | |
| JP | 2005-049022 | A | | 2/2005 | |
| JP | 2005351587 | | | 12/2005 | |
| JP | 2008-249264 | A | | 10/2008 | |

OTHER PUBLICATIONS

Office Action issued on Jun. 20, 2013, by the Chinese Patent Office in corresponding Chinese Patent Application No. 2008801305531, and an English Translation of the Office Action. (11 pages).

Office Action (Notice of Reasons for Rejection) dated Aug. 14, 2012, issued in corresponding Japanese Patent Application No. 2010-535543, and an English Translation thereof. (5 pages).

Office Action (Notification of the Third Office Action) issued on Sep. 17, 2013, by the Chinese Patent Office in corresponding Chinese Patent Application No. 200880130553.1, and an English Translation of the Office Action. (5 pages).

International Search Report (PCT/ISA/210) issued on Jan. 29, 2009, by Japanese Patent Office as the International Searching Authority for International Application No. PCT/JP2008/069602.

Chinese Office Action dated Dec. 20, 2012, issued in corresponding Chinese Patent Application No. 2008801305531 and English translation. (6 pages).

Extended European Search Report dated Apr. 22, 2014, issued by the European Patent Office in corresponding European Patent Application No. 08877712.3-1602 / 2314945. (7 pages).

* cited by examiner

AIR-CONDITIONING APPARATUS

TECHNICAL FIELD

The present invention relates to an air-conditioning apparatus such as a multiple-air conditioner for buildings.

BACKGROUND ART

In an air-conditioning apparatus such as a multi air-conditioner for buildings, a refrigerant is made to circulate between, for example, an outdoor unit, which is a heat source apparatus, disposed outside a building and an indoor unit disposed inside of the building. Through radiation or absorption of heat by the refrigerant, the heated or cooled air is carried to the space subjected to air-conditioning to perform cooling or heating. As for the refrigerant, HFC (hydrofluorocarbon) refrigerant is often used, for example. Alternatively, a natural refrigerant such as carbon dioxide ($CO_2$) is proposed, as well.

In the air-conditioning apparatus called a chiller, cooling energy or heating energy is generated in the heat source apparatus disposed outside the building. By performing heat exchange with the refrigerant in a heat exchanger of a refrigeration cycle arranged in the outdoor unit, a heat medium such as water and anti-freezing liquid is heated or cooled and by carrying it to a fan coil unit, panel heater, or the like which is the indoor unit, cooling or heating has been performed. There also is an apparatus called a waste heat recovery type chiller in which four water pipelines are connected to a heat source apparatus to supply cooled or heated water and the like simultaneously. (Refer to Patent Literature 1, for example)

Patent Literature 1 Japanese Patent No. 2003-343936A

SUMMARY OF INVENTION

Technical Problem

In the conventional air-conditioning apparatus, since the refrigerant is made to circulate into the indoor unit, the refrigerant may be leaked indoors. On the other hand, the air-conditioning apparatus like the chiller, no refrigerant passes through the indoor unit. However, it is necessary to heat or cool the heat medium in the heat source apparatus outside the building to carry the heat medium into the indoor unit side. Therefore, a circulation path of water and anti-freezing liquid and the like, whose energy consumption for carrying heat amount necessary for heat exchange is larger than the case of the refrigerant, becomes longer resulting in an extremely large carrying power. When a case is considered where a air-conditioning load in cooling or heating increases, for example, it is more effective for energy-saving when increasing heat amount related to heat exchange to control the heat amount related to heat exchange between the refrigerant and the heat medium than to increase carrying power by making more refrigerant circulate. Further, in some cases, circulation of the heat medium in a heat medium circulation circuit cannot cope with the load.

The present invention is made to solve the above problems and its object is to provide an air-conditioning apparatus that is safe since no problem of leaking indoors of the refrigerant occurs unlike the air-conditioning apparatus such as a multi air-conditioning apparatus for buildings because no refrigerant is made to circulate into the indoor unit, and that can achieve energy-saving because a water circulation path is shorter than the air-conditioning apparatus such as a chiller.

The air-conditioning apparatus according to the present invention includes: a refrigeration cycle that connects a compressor to compress the refrigerant, a refrigerant flow path switching apparatus to switch the circulation path of the refrigerant, a heat source side heat exchanger to make the refrigerant exchange heat, a first expansion valve to adjust the pressure of the refrigerant, an intermediate heat exchanger that exchanges heat between the refrigerant and a heat medium different from the refrigerant to heat the heat medium, and another intermediate heat exchanger to cool the heat medium by piping, and a heat medium circulation circuit that connects the intermediate heat exchanger to heat the heat medium, the intermediate heat exchanger to cool the heat medium, a pump to make the heat medium related to heat exchange of each intermediate heat exchanger circulate, and a plurality of use side heat exchangers that exchange heat between the heat medium and the air related to the space subjected to air-conditioning by piping. The heat source side heat exchanger, the intermediate heat exchangers, and the use side heat exchangers are separately formed respectively and adapted to be disposed at separate locations from each other.

Advantageous Effects of Invention

According to the present invention, in the indoor unit for heating or cooling the air subjected to air-conditioning, the heat medium circulates and no refrigerant circulates. Therefore, even if the refrigerant leaks from piping, for example, ingress of the refrigerant into the space subjected to air-conditioning can be suppressed, resulting in a safe air-conditioning apparatus. By providing a relay unit having the intermediate heat exchanger as a separate unit from the outdoor unit and the indoor unit, the carrying power of the heat medium is less than the case where the heat medium is made directly to circulate between the outdoor unit and the indoor unit. Accordingly, energy-saving can be achieved.

REFERENCE SIGNS LIST

Figure 1:
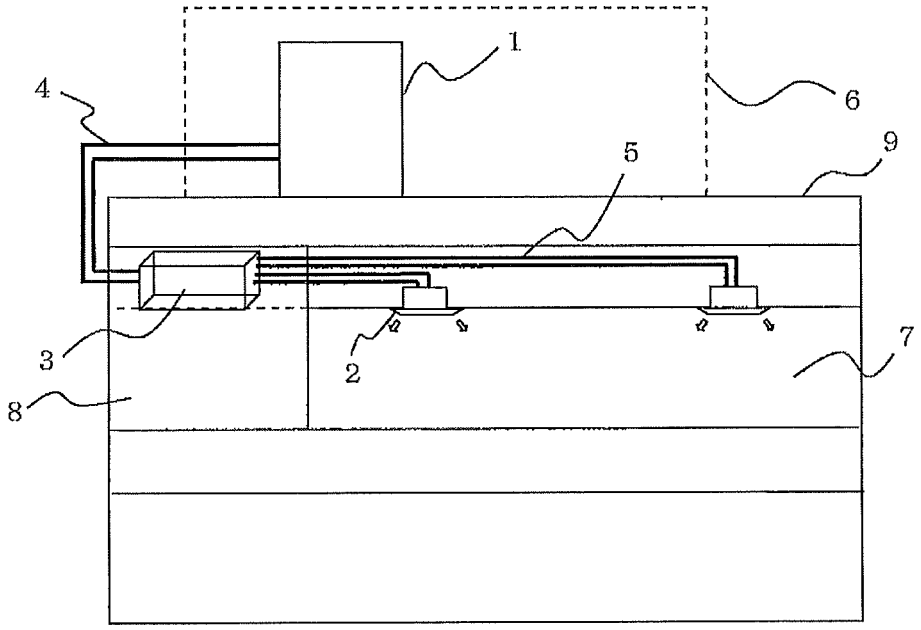
FIG. 1 is a diagram showing an example of installation of an air-conditioning apparatus according to an embodiment of the present invention.

1 heat source apparatus (outdoor unit)
2, 2*a*, 2*b*, 2*c*, 2*d* indoor unit
3 relay unit
3*a* main relay unit
3*b*(1), 3*b*(2) sub relay unit
4 refrigerant pipeline
5, 5*a*, 5*b*, 5*c*, 5*d* heat medium pipeline
6 outdoor space
7 indoor space
8 non-air conditioned space
9 building
10 compressor
11 four-way valve
12 heat source side heat exchanger
13*a*, 13*b*, 13*c*, 13*d* check valve
14 gas-liquid separator
15*a*, 15*b* intermediate heat exchanger
16*a*, 16*b*, 16*c*, 16*d*, 16*e* expansion valve
17 accumulator
21*a*, 21*b* pump (heat medium feeding-out apparatus)
22*a*, 22*b*, 22*c*, 22*d* flow path switching valve
23*a*, 23*b*, 23*c*, 23*d* flow path switching valve
24*a*, 24*b*, 24*c*, 24*d* stop valve
25*a*, 25*b*, 25*c*, 25*d* flow amount adjustment valve
26*a*, 26*b*, 26*c*, 26*d* use side heat exchanger
31*a*, 31*b* first temperature sensor
32*a*, 32*b* second temperature sensor
33*a*, 33*b*, 33*c*, 33*d* third temperature sensor
34*a*, 34*b*, 34*c*, 34*d* fourth temperature sensor
35 fifth temperature sensor
36 pressure sensor
37 sixth temperature sensor
38 seventh temperature sensor
41*a*, 41*b*, 41*c*, 41*d* flow amount meter
100 outdoor unit side controller
200 signal line
300 relay unit side controller

DESCRIPTION OF EMBODIMENTS

Embodiment 1

FIG. 1 is a diagram showing an example of installation of an air-conditioning apparatus according to an embodiment of the present invention. The air-conditioning apparatus of FIG. 1 includes an outdoor unit 1, which is a heat source apparatus, one or a plurality of indoor units 2 for performing air-conditioning of the space to be air-conditioned, and a relay unit 3 that exchanges heat between the refrigerant and a medium (hereinafter, referred to as a heat medium) which is different from the refrigerant and carries heat (heat amount) to relay heat transmission, as separate units. The outdoor unit 1 and the relay unit 3 are connected by refrigerant pipeline 4 so as to allow a refrigerant such as a pseudo-azeotropic mixture refrigerant such as R-410A and R-404A to circulate and transfer heat. On the other hand, the relay unit 3 and the indoor unit 2 are connected by the heat medium pipeline 5 so as to allow heat medium such as plain water, water, to which a non-volatile or low-volatile preservatives within air-conditioning temperature range is added, and anti-freezing liquid to circulate in order to transfer heat.

Here, in the present embodiment, the outdoor unit 1 is disposed in the outdoor space 6, which is a space outside the buildings 9. The indoor unit 2 is disposed at a location where the air in the indoor space 7, which is a space to be air-conditioned such as a living room in the buildings 9, can be heated or cooled. The relay unit 3 where the refrigerant flows in and flows out is disposed in a non-air conditioning space 8 inside the building which is different from the outdoor space 6 and the indoor space 7. In order to minimize influences (such as a sense of discomfort) of the refrigerant on humans caused by the occurrence of refrigerant leakage and so on, the non-air conditioned space 8 is made to be a space having no or few visitors. In FIG. 1, in the non-air conditioned space 8 such as a ceiling space under the roof being partitioned by walls from the indoor space 7, the relay unit 3 is disposed. The relay unit 3 can be disposed in, for example, a common use space where an elevator is installed as the non-air conditioned space 8.

It is configured that the outdoor unit 1 and the relay unit 3 of the present embodiment can be connected using two refrigerant pipelines 4. It is also configured that the relay unit 3 and each indoor unit 2 can be connected using two heat-medium pipelines 5 respectively. Such connection configuration allows two pipelines (especially, refrigerant pipelines 4) to pass through a wall of the buildings 9, facilitating the construction of the air-conditioning apparatus to the buildings 9.

Figure 2:
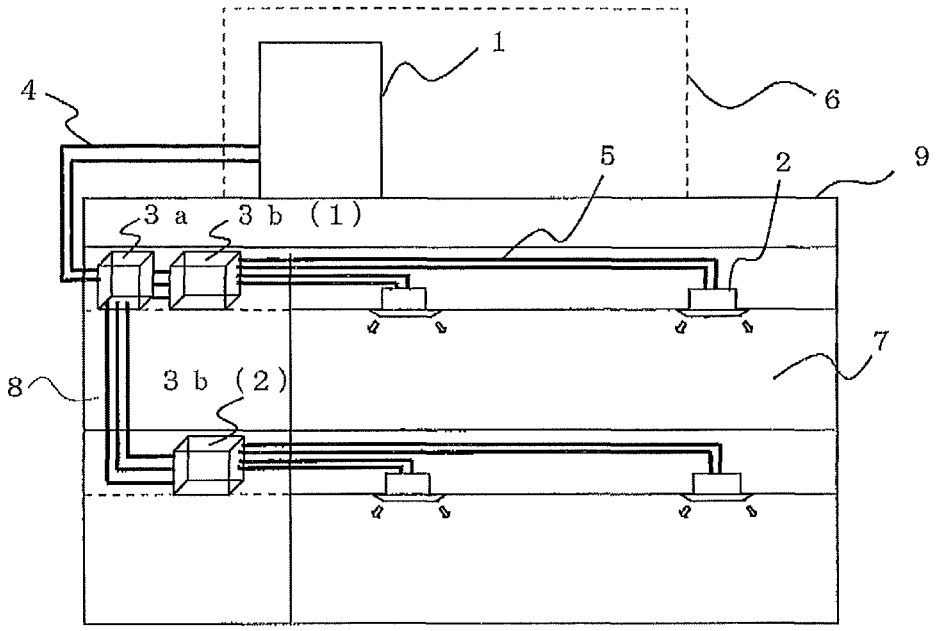
FIG. 2 is a diagram showing another example of installation of an air-conditioning apparatus.

FIG. 2 is a diagram showing another example of installation of the air-conditioning apparatus. In FIG. 2, the relay unit 3 is divided into a main relay unit 3*a* and a plurality of sub relay units 3*b* (1) and 3*b* (2). Although details of the configuration will be mentioned later, by dividing the relay unit 3 into the main relay unit 3*a* and the sub relay unit 3*b*, a plurality of sub relay units 3*b* can be connected with one main relay unit 3*a*. In the configuration of the present embodiment, there are three connection-pipelines connecting between the main relay unit 3*a* and each sub relay unit 3*b*.

Here, examples are shown in FIGS. 1 and 2 in which the indoor unit 2 is made to be a ceiling cassette type. However, it is not limited thereto. For example, any type such as a ceiling-concealed type and a ceiling-suspended type will be allowable as long as heated or cooled air can be supplied into the indoor space 7 directly or through a duct.

Although the outdoor unit 1 is explained with the case of being disposed in the outdoor space 6 outside the building 9 as an example, it is not limited thereto. For example, the heat source apparatus 1 may be disposed in a surrounded space like a machine room with a ventilating opening. The outdoor unit 1 may be disposed inside the building 9 and air may be exhausted heat to outside of the building 9 through an exhaust duct. Alternatively, using a water-cooled type heat source apparatus, the outdoor unit 1 may be disposed in the building 9.

The relay unit 3 may be disposed near the outdoor unit 1, which may be against energy-saving.

Figure 3:
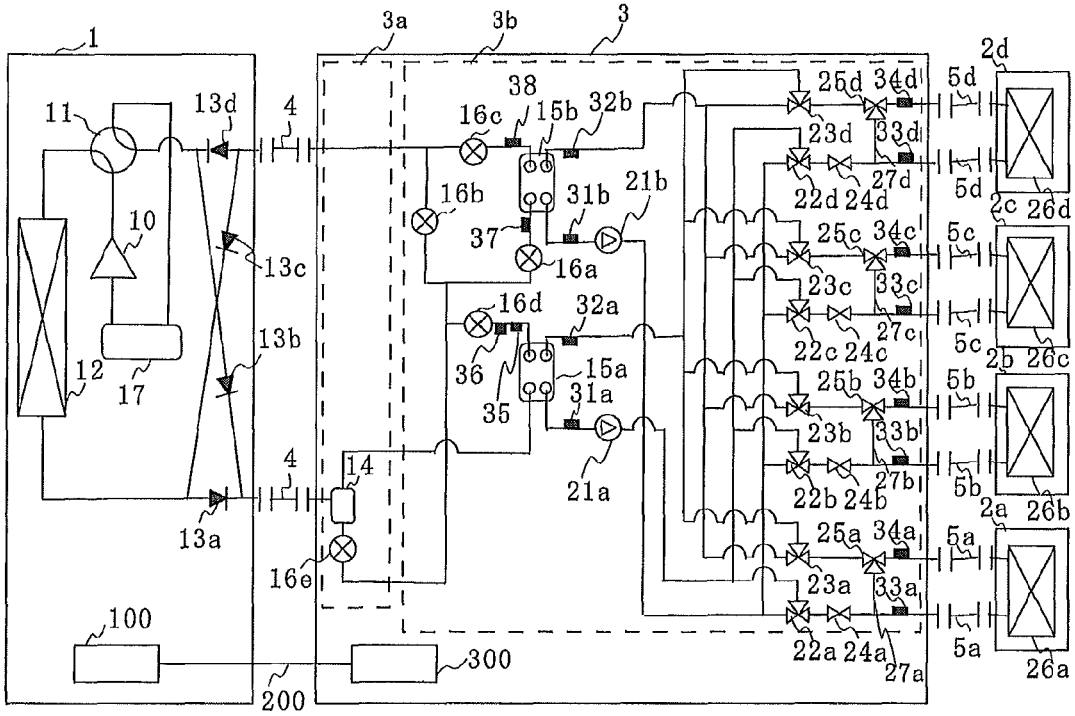
FIG. 3 is a diagram illustrating the configuration of an air-conditioning apparatus according to Embodiment 1.

FIG. 3 is a diagram illustrating the configuration of an air-conditioning apparatus according to Embodiment 1. The air-conditioning apparatus of the present embodiment has a refrigeration cycle apparatus configuring a refrigeration cycle (a refrigerant circuit, a primary side circuit) by connecting, by piping, a compressor 10, a four-way valve 11, a heat source side heat exchanger 12, check valves 13*a*, 13*b*, 13*c*, and 13*d*, a gas-liquid separator 14*a*, intermediate heat exchangers 15*a* and 15*b*, expansion valves 16*a*, 16*b*, 16*c*, 16*d*, and 16*e* to be throttle devices, and an accumulator 17.

The compressor 10 compresses the sucked refrigerant to discharge (send out) it. The four-way valve 11, which is a refrigerant flow path switching apparatus, switches valves corresponding to an operation form (mode) related to cooling and heating based on instructions of the outdoor unit side controller 100 to switch the refrigerant flow path. In the present embodiment, the circulation path is made to be switched according to the time of cooling only operation (here, all indoor units 2 in operation perform cooling (including dehumidifying, hereinafter the same)) and cooling-main operation (cooling becomes dominant in simultaneous cooling and heating operation), and the time of heating only operation (here, all indoor units 2 in operation perform heating) and heating-main operation (heating becomes dominant in simultaneous cooling and heating operation).

The heat source side heat exchanger 12 has a heat-transfer tube to feed the refrigerant and a fin (not shown) to enlarge a heat-transfer area between the refrigerant flowing in the heat-transfer tube and the outside air to exchange heat between the refrigerant and the air (outside air). For example, in heating only operation and heating-main operation, the heat source side heat exchanger 12 operates as an evaporator to evaporate and gasify the refrigerant. On the other hand, in cooling only operation and cooling-main operation, the heat source side heat exchanger 12 operates as a condenser or gas cooler. Then, in some cases, like in cooling-main operation, the refrigerant is not completely gasified or liquefied but condensed up to the two-phase mixture (gas-liquid two-phase refrigerant) state of the liquid and gas.

Check valves 13*a*, 13*b*, 13*c*, and 13*d* prevent the refrigerant from flowing back to adjust the refrigerant flow and to keep a circulation path of the refrigerant flow into and out of the outdoor unit 1 constant. The gas-liquid separator 14 separates the refrigerant flowing from the refrigerant pipeline 4 into a gas refrigerant and a liquid refrigerant. The intermediate heat exchangers 15*a* and 15*b* have a heat-transfer tube for feeding the refrigerant and another heat-transfer tube for feeding the heat medium to exchange heat between the refrigerant and the heat medium. In the present embodiment, the intermediate heat exchanger 15*a* functions as a condenser or a gas cooler in heating only operation, cooling-main operation, and heating-main operation to heat the heat medium. The intermediate heat exchanger 15*b* functions as an evaporator in cooling only operation, cooling-main operation, and heating-main operation to cool the heat medium. For example, expansion valves 16*a*, 16*b*, 16*c*, 16*d*, and 16*e* such as electronic expansion valves decompress the refrigerant by adjusting the refrigerant flow amount. The accumulator 17 has operation of storing a surplus refrigerant in the refrigeration cycle and preventing the compressor 10 from being damaged by a great amount of the refrigerant liquid returning thereto.

In FIG. 3, the above-mentioned intermediate heat exchangers 15*a* and 15*b*, heat medium feeding-out means 21*a* and 21*b*, flow path switching valves 22*a*, 22*b*, 22*c*, 22*d*, 23*a*, 23*b*, 23*c*, and 23*d*, stop valves 24*a*, 24*b*, 24*c*, and 24*d*, flow amount adjustment valves 25*a*, 25*b*, 25*c*, and 25*d*, use side heat exchangers 26*a*, 26*b*, 26*c*, and 26*d*, and heat medium bypass pipelines 27*a*, 27*b*, 27*c*, and 27*d* are connected with piping to configure a heat medium circulation circuit (a secondary side circuit).

The pumps 21*a* and 21*b*, which are heat medium feeding-out apparatus, pressurize the heat medium to let the same circulate. The use side heat exchangers 26*a*, 26*b*, 26*c*, and 26*d* exchange heat between the heat medium and the air to be supplied into the indoor space 7 to heat or cool the air to be fed into the indoor space 7 in each indoor unit 2*a*, 2*b*, 2*c*, and 2*d*. In the present embodiment, each flow path switching valve 22*a*, 22*b*, 22*c*, and 22*d*, which is a three-way switching valve and the like, switches a flow path at the inlet side (heat medium flow-in side) of the use side heat exchangers 26*a*, 26*b*, 26*c*, and 26*d*, respectively. Each flow path switching valve 23*a*, 23*b*, 23*c*, and 23*d* switches a flow path at the outlet side (heat medium flow-out side) of the use side heat exchangers 26*a*, 26*b*, 26*c*, and 26*d*, as well. Here, these switching apparatuses perform switching in order to let either of the heat medium related to heating or the heat medium related to cooling pass through the use side heat exchangers 26*a*, 26*b*, 26*c*, and 26*d*. The stop valves 24*a*, 24*b*, 24*c*, and 24*d* are opened/closed based on the instructions from the relay unit controller 300 in order to make the heat medium pass through or be shut off from the use side heat exchangers 26*a*, 26*b*, 26*c*, and 26*d*.

Each flow amount adjustment valve 25*a*, 25*b*, 25*c*, and 25*d*, which are three-way flow amount adjustment valves, adjusts ratio of the heat medium passing through the use side heat exchangers 26*a*, 26*b*, 26*c*, and 26*d* and heat medium bypass pipelines 27*a*, 27*b*, 27*c*, and 27*d* based on the instructions from the relay unit side controller 300. Each heat medium bypass pipelines 27*a*, 27*b*, 27*c*, and 27*d* allows the heat medium that does not flow through the use side heat exchangers 26*a*, 26*b*, 26*c*, and 26*d* by adjusting the flow amount adjustment valves 25*a*, 25*b*, 25*c*, and 25*d* to pass therethrough.

Each first temperature sensor 31*a* and 31*b* is a temperature sensor to detect the temperature of the heat medium at the heat medium outlet side (heat medium flow-out side) of the intermediate heat exchangers 15*a* and 15*b*. Each second temperature sensor 32*a* and 32*b* is a temperature sensor to detect the temperature of the heat medium at the heat medium inlet side (heat medium flow-in side) of the intermediate heat exchangers 15*a* and 15*b*. Each third temperature sensor 33*a*, 33*b*, 33*c*, and 33*d* is a temperature sensor to detect the temperature of the heat medium at inlet side (flow-in side) of the use side heat exchangers 26*a*, 26*b*, 26*c*, and 26*d*. Each fourth temperature sensor 34*a*, 34*b*, 34*c*, and 34*d* is a temperature sensor to detect the temperature of the heat medium at the heat medium outlet side (flow-out side) of the use side heat exchangers 26*a*, 26*b*, 26*c*, and 26*d*. Hereinafter, for example, as to the same means such as the fourth temperature sensors 34*a*, 34*b*, 34*c*, and 34*d*, subscripts will be omitted for example or the notation will be the fourth temperature sensors 34*a* to 34*d* when they need not to be distinguished in particular. Other apparatuses and means will be the same.

The fifth temperature sensor 35 is a temperature sensor to detect the refrigerant temperature at the refrigerant outlet side (refrigerant flow-out side) of the intermediate heat exchanger 15*a*. The pressure sensor 36*a* is a pressure sensor to detect the refrigerant pressure at the refrigerant outlet side (refrigerant flow-out side) of the intermediate heat exchanger 15*a*. The sixth temperature sensor 37 is a temperature sensor to detect the refrigerant temperature at the refrigerant inlet side (refrigerant flow-in side) of the intermediate heat exchanger 15*b*. The seventh temperature sensor 38 is a temperature sensor to detect the refrigerant temperature at the refrigerant outlet side (refrigerant flow-out side) of the intermediate heat exchanger 15*b*. From the above-mentioned temperature detection means and pressure detection means, signals related to detected temperature values and pressure values are transmitted to the relay unit controller 300.

In the present embodiment, at least the outdoor unit 1 and the relay unit 3 include the outdoor unit side controller 100 and the relay unit controller 300, respectively. The outdoor unit side controller 100 and the relay unit controller 300 are connected by communication lines 102 to perform signal communication including various data. The outdoor unit side controller 100 performs processing to perform control such as to transmit signals related to the command to each apparatus accommodated especially in the outdoor unit 1 of the refrigeration cycle apparatus. Therefore, a storage device (not shown) is provided that stores various data and programs necessary for processing data for detecting various detection means temporarily or for a long time. The relay unit controller 300 performs processing to perform control such as to transmission of signals related to the command to each apparatus accommodated in the relay unit 3 such as apparatuses of the heat medium circulation circuit. The relay unit side controller 300 has the storage device (not shown) as well. Here, in the present embodiment, although the outdoor unit side controller 100 and the relay unit side controller 300 are adapted to be installed inside the outdoor unit 1 and the relay unit 3 respectively, the installation place is not limited, such as being installed nearby as long as each apparatus can be controlled.

In the present embodiment, the compressor 10, the four-way valve 11, the heat source side heat exchanger 12, the check valves 13*a* to 13*d*, the accumulator 17, and the indoor unit side controller 100 are accommodated in the outside unit 1. Each use side heat exchanger 26*a* to 26*d* is accommodated in each indoor unit 2*a* to 2*d*, respectively.

In the present embodiment, among devices related to the heat medium circulation circuit and the refrigeration cycle apparatus, the gas-liquid separator 14 and the expansion valves 16*a* to 16*e* are accommodated in the relay unit 3. The first temperature sensors 31*a* and 31*b*, the second temperature sensors 32*a* and 32*b*, the third temperature sensors 33*a* to 33*d*, the fourth temperature sensors 34*a* to 34*d*, the fifth temperature sensor 35, the pressure sensor 36, the sixth temperature sensor 37, and the seventh temperature sensor 38 are accommodated in the relay unit 3, too.

Here, in a case where the main relay unit 3*a* and one or a plurality of the sub relay units 3*b* are installed separately as shown in FIG. 2, the gas-liquid separator 14 and the expansion valves 16*e* are accommodated in the main relay unit 3*a* as shown by the dotted line in FIG. 3, for example. The intermediate heat exchangers 15*a* and 15*b*, the expansion valves 16*a* to 16*d*, the pumps 21*a* and 21*b*, the flow path switching valves 22*a* to 22*d* and 23*a* to 23*d*, the stop valves 24*a* to 24*d*, and the flow amount adjustment valve 25*a* to 25*d* are accommodated in the relay unit 3*b*.

Next, descriptions will be given to operations of the air-conditioning apparatus in each operation mode based on the refrigerant and heat medium flow. Here, the pressure in the refrigeration cycle is not determined by the relation to the standard pressure but it is represented by high or low pressures as a relative pressure generated by the compression of the compressor 1 and the refrigerant flow amount control of the expansion valves 16*a* to 16*e*. It is assumed to be the same for the temperature.

Cooling Only Operation

Figure 4:
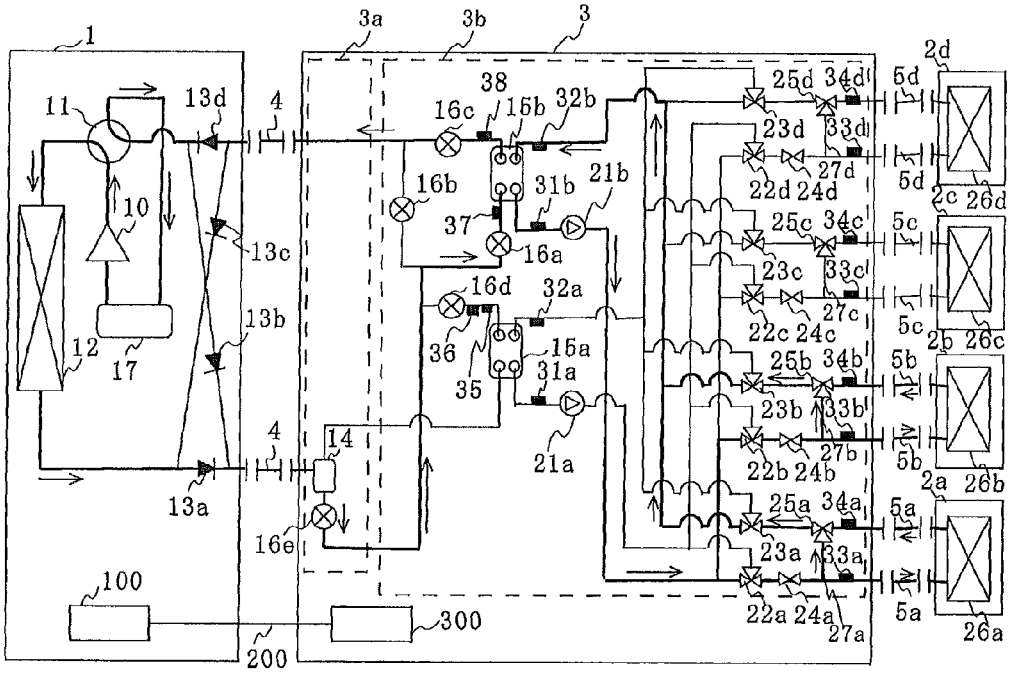
FIG. 4 is a diagram showing a refrigerant and a heat medium flow at the time of cooling only operation.

FIG. 4 is a diagram showing the flow of a refrigerant and a heat medium at the time of cooling only operation respectively. Here, descriptions will be given to a case where the indoor units 2*a* and 2*b* perform cooling of the indoor space 7 and the indoor units 2*c* and 2*d* are stopped. Firstly, the refrigerant flow in the refrigeration cycle will be explained. In the outdoor unit 1, the refrigerant sucked by the compressor 10 is compressed and discharged as a high-pressure gas refrigerant. The refrigerant having flowed out of the compressor 10 flows into the heat source side heat exchanger 12 that functions as a condenser through the four-way valve 11. The high-pressure gas refrigerant is condensed by the heat exchange with the air while passing through the heat source side heat exchange 12 to turn into a high-pressure liquid refrigerant and flows through the check valve 13*a* (does not flow through the check valves 13*b* and 13*c* side because of the refrigerant pressure), further flowing into the relay unit 3 via the refrigerant pipeline 4.

The refrigerant having flowed into the relay unit 3 passes through the gas-liquid separator 14. At the time of cooling only operation, since the liquid refrigerant flows into the relay unit 3, no gas refrigerant flows in the intermediate heat exchanger 15*a* and the intermediate heat exchanger 15*a* does not function. On the other hand, the liquid refrigerant passes through the expansion valves 16*e* and 16*a* to flow into the intermediate heat exchanger 15*b*. Here, since the relay unit side controller 300 controls the opening-degree of the expansion valve 16*a* to decompress the refrigerant by adjusting the refrigerant flow amount, the low-temperature low-pressure gas-liquid two-phase refrigerant flows into the intermediate heat exchanger 15*b*. Here, the relay unit side controller 300 performs control (superheat control) of the opening-degree of the expansion valve 16*a* to make the temperature difference between the inlet (flow-in) side and the outlet (flow-out) side of the refrigerant in the intermediate heat exchanger 15*b* approach a control target value. The controller also controls the opening-degree of the expansion valve 16*e* to make the pressure difference between the pressure in the gas-liquid separator 14 and the medium pressure approach a target value.

Since the intermediate heat exchanger 15*b* acts as an evaporator to the refrigerant, the refrigerant passing through the intermediate heat exchanger 15*b* turns into a low-temperature low-pressure gas refrigerant and flows out while cooling the heat medium as an heat exchange object (while absorbing heat from the heat medium). The gas refrigerant having flowed out of the intermediate heat exchanger 15*b* passes through the expansion valve 16*c* to flow out from the relay unit 3. Then, it passes through the refrigerant pipeline 4 to flow into the outdoor unit 1. Here, at the time of cooling only operation, the expansion valves 16*b* and 16*d* are made to have opening-degree with which no refrigerant flows, based on the instructions from the relay unit side controller 300. The expansion valve 16*c* is made to be full open based on the instructions from the relay unit side controller 300 in order that no pressure loss may be generated.

The refrigerant having flowed into the outdoor unit 1 passes through the check valve 13*d* to be sucked into the compressor 10 again via the four-way valve 11 and the accumulator 17.

Next, descriptions will be given to the heat medium flow in the heat medium circulation circuit. Here, in FIG. 4, it is not necessary to make the heat medium to pass through the use side heat exchanger 26*c* and 26*d* of the indoor units 2*c* and 2*d* subjected to no air-conditioning load because of stop. (The indoor space 7 needn't be cooled. A state of thermo-off is included.) Then, based on the instructions from the relay unit side controller 300, the check valves 24*c* and 24*d* are closed so that no heat medium is made to flow into the use side heat exchangers 26*c* and 26*d*.

The heat medium is cooled by the heat exchange with the refrigerant in the intermediate heat exchanger 15*b*. Then, the cooled heat medium is sucked by the pump 21 to be sent out. The heat medium having flowed out of the pump 21*b* passes through the flow path switching valves 22*a* and 22*b* and the stop valves 24*a* and 24*b*. Then, through the flow amount adjustment by the flow amount adjustment valves 25*a* and 25*b* based on the instructions from the relay unit side controller 300, the heat medium flows into the use side heat exchangers 26*a* and 26*b*, which covers (supplies) a necessary heat amount for the air-conditioning load to cool the air in the indoor space 7. Here, the relay unit side controller 300 makes the flow amount adjustment valves 25*a* and 25*b* to adjust the ratio of the heat medium passing through the use side heat exchangers 26*a* and 26*b* and the heat medium bypass pipelines 27*a* and 27*b* so as to make the use side heat exchanger outlet/inlet temperature difference between the temperature related to the detection of the third temperature sensors 33*a* and 33*b* and the temperature related to the detection of the fourth temperature sensors 34*a* and 34*b* to approach a set control target value.

The heat medium having flowed into the use side heat exchangers 26*a* and 26*b* exchanges heat with the air in the indoor space 7 and flows out. On the other hand, the remaining heat medium that has not flowed into the use side heat exchangers 26*a* and 26*b* passes through the heat medium bypass pipelines 27*a* and 27*b* with no contribution to air-conditioning of the indoor space 7.

The heat medium having flowed out of the use side heat exchangers 26*a* and 26*b* and the heat medium having passed through the heat medium bypass pipelines 27*a* and 27*b* meet at the flow amount adjustment valves 25*a* and 25*b* and pass through the flow path switching valves 23*a* and 23*b* to flow into the intermediate heat exchanger 15*b*. The heat medium cooled in the intermediate heat exchanger 15*b* is sucked by the pump 21*b* again to be sent out.

Heating Only Operation

Figure 5:
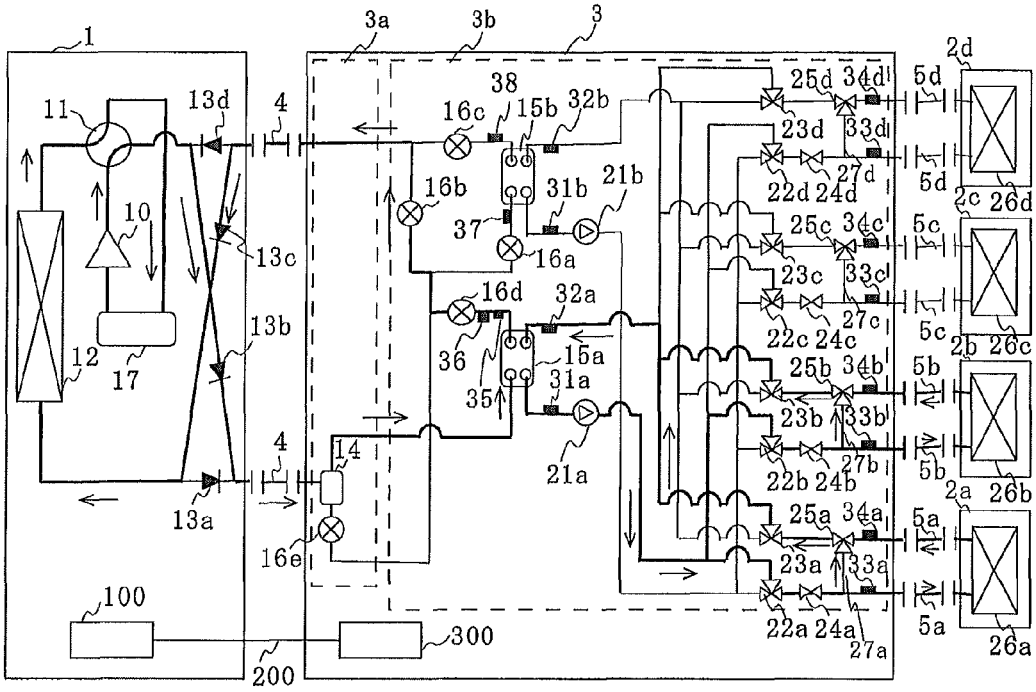
FIG. 5 is a diagram showing the refrigerant and the heat medium flow at the time of heating only operation.

FIG. 5 is a diagram showing the refrigerant and the heat medium flow at the time of heating only operation respectively. Here, descriptions will be given to a case where the indoor units 2*a* and 2*b* perform heating and the indoor units 2*c* and 2*d* are stopped. Firstly, the refrigerant flow in the refrigeration cycle will be explained. In the outdoor unit 1, the refrigerant sucked into the compressor 10 is compressed and discharged as a high-temperature gas refrigerant. The refrigerant having flowed out of the compressor 10 flows through the four-way valve 11 and the check valve 13*b*. Further it passes through the refrigerant pipeline 4 to flow into the relay unit 3.

The refrigerant having flowed into the relay unit 3 passes through the gas-liquid separator 14. Since the refrigerant flowing into the relay unit 3 at the time of heating only operation is a gas refrigerant, no liquid refrigerant flows into the intermediate heat exchanger 15*b* and the intermediate heat exchanger 15*b* does not function. On the other hand, the gas refrigerant flows into the intermediate heat exchanger 15*a*. Since the intermediate heat exchanger 15*a* acts on the refrigerant as a condenser, the refrigerant passing through the intermediate heat exchanger 15*a* turns into a liquid refrigerant to flow out while heating the heat medium as an heat exchange object (while releasing heat to the heat medium) and flows out.

The refrigerant having flowed out from the intermediate heat exchanger 15*a* passes through the expansion valves 16*d* and 16*e*, flows out from the relay unit 3, and flows into the outdoor unit 1 via the refrigerant pipeline 4. Then, since the relay unit side controller 300 adjusts the refrigerant flow amount by controlling the opening-degree of the expansion valve 16*d* to decompress the refrigerant, a low-temperature low-pressure gas-liquid two-phase refrigerant flows out from the relay unit 3. Here, the relay unit side controller 300 performs opening-degree control (subcool control) of the expansion valve 16*d* such that the temperature difference between the saturation temperature of the outlet (flow-out) side pressure of the refrigerant in the intermediate heat exchanger 15*a* and outlet side temperature is made to approach a control target value. The expansion valves 16*b* and 16*c* are made to be full open based on instructions from the relay unit side controller 300 so that no pressure loss is generated. Then, expansion valves 16*a* and 16*e* are made to have an opening-degree such that no refrigerant flows.

The refrigerant having flowed into the outdoor unit 1 flows into the heat source side heat exchanger 12 that functions as an evaporator via the check valve 13*c*. The low-temperature low-pressure gas-liquid two-phase refrigerant evaporates through heat exchange with the air while passing through the heat source side heat exchanger 12 and turns into a low-temperature low-pressure gas refrigerant. The refrigerant having flowed out from the heat source side heat exchanger 12 is sucked into the compressor 10 again through the four-way valve 11 and the accumulator 17.

Next, descriptions will be given to the heat medium flow in the heat medium circulation circuit. Here, in FIG. 5, there is no need to make the heat medium to pass through the use side heat exchangers 26*c* and 26*d* of the indoor units 2*c* and 2*d* to which no air-conditioning load is imposed because of the stop. (The indoor space 7 needn't be cooled. A state of thermo-off is included.) Therefore, the stop valves 24*c* and 24*d* are closed based on instructions from the relay unit side controller 300 so that no heat medium flows in the use side heat exchangers 26*c* and 26*d*.

The heat medium is heated by heat exchange with the refrigerant in the intermediate heat exchanger 15*a*. The heated heat medium is sucked by the pump 21*a* to be sent out. The heat medium having flowed out from the pump 21*a* passes through the flow path switching valves 22*a* and 22*b* and stop valves 24*a* and 24*b*. Through the flow amount adjustment by the flow amount adjustment valves 25*a* and 25*b* based on the instructions from the relay unit side controller 300, the heat medium that covers (supplies) necessary heat amount for the air-conditioning load to heat the air in the indoor space 7 flows into the use side heat exchangers 26*a* and 26*b*. Here, in heating only operation, the relay unit side controller 300 makes the flow amount adjustment valves 25*a* and 25*b* to adjust the ratio of the heat medium passing through the use side heat exchangers 26*a* and 26*b* and the heat medium bypass pipelines 27*a* and 27*b* so that the temperature differences between the temperatures related to the detection by the third temperature sensors 33*a* and 33*b* and the temperatures related to the detection by the fourth temperature sensors 34*a* and 34*b* are made to be a set target value.

The heat medium having flowed into the use side heat exchangers 26*a* and 26*b* exchanges heat with the air in the indoor space 7 and flows out. On the other hand, the remaining heat medium that has not flowed into the use side heat exchangers 26*a* and 26*b* passes through the heat medium bypass pipelines 27*a* and 27*b* with no contribution to air-conditioning of the indoor space 7.

The heat medium having flowed out of the use side heat exchangers 26*a* and 26*b* and the heat medium having passed through the heat medium bypass pipelines 27*a* and 27*b* meet at the flow amount adjustment valves 25*a* and 25*b* and pass through the flow path switching valves 23*a* and 23*b* to flow into the intermediate heat exchanger 15*a*. The heat medium heated in the intermediate heat exchanger 15*b* is sucked by the pump 21*a* again to be sent out.

Cooling-Main Operation

Figure 6:
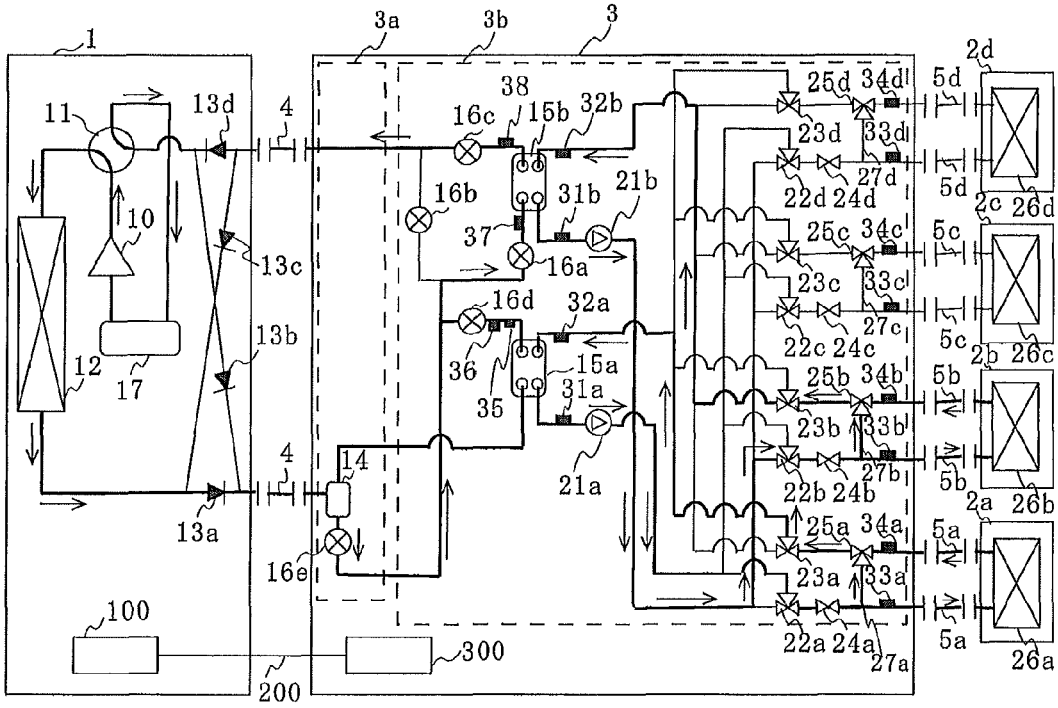
FIG. 6 is a diagram showing the refrigerant and the heat medium flow at the time of cooling-main operation.

FIG. 6 is a diagram showing the refrigerant and the heat medium flow at the time of cooling-main operation. Here, descriptions will be given to a case where the indoor unit 2*a* performs heating, the indoor unit 2*b* performs cooling, and the indoor units 2*c* and 2*d* are stopped. Firstly, the refrigerant flow in the refrigeration cycle will be explained. In the outdoor unit 1, the refrigerant sucked into the compressor 10 is compressed and discharged as a high-temperature gas refrigerant. The refrigerant having flowed out from the compressor 10 flows into the heat source side heat exchanger 12 via the four-way valve 11. The high-pressure gas refrigerant is condensed through heat exchange with the air while passing through the heat source side heat exchanger 12. Here, in the case of cooling-main operation, the gas-liquid two-phase refrigerant is adapted to flow out from the heat source side heat exchanger 12. The gas-liquid two-phase refrigerant having flowed out from the heat source side heat exchanger 12 flows through the check valve 13*a*. Then it flows into the relay unit 3 via the refrigerant piping 4.

The refrigerant having flowed into the relay unit 3 passes through the gas-liquid separator 14. The gas-liquid two-phase refrigerant is separated into the liquid refrigerant and the gas refrigerant in the gas-liquid separator 14. The gas refrigerant separated in the gas-liquid separator 14 flows into the intermediate heat exchanger 15*a*. The refrigerant flowed into the intermediate heat exchanger 15*a* turns into a liquid refrigerant while heating the heat medium as a heat-exchange object by condensation, and flows out to pass through the expansion valve 16*d*. The relay unit side controller 300 performs opening-degree control (subcool control) of the expansion valve 16*d* such that the temperature difference between the saturation temperature of the outlet (flow-out) side pressure of the refrigerant in the intermediate heat exchanger 15*a* and outlet side temperature is made to approach a control target value.

On the other hand, the liquid refrigerant separated in the gas-liquid separator 14 passes through the expansion valve 16*e*, meets with the liquid refrigerant passing through the expansion valve 16*d*, passes through the expansion valve 16*a* and flows into the intermediate heat exchanger 15*b*. Here, since the relay unit side controller 300 decompresses the refrigerant by controlling the opening-degree of the expansion valve 16*a* to adjust the refrigerant flow amount, a low-temperature low-pressure gas-liquid two-phase refrigerant flows into the intermediate heat exchanger 15*b*. The refrigerant having flowed into the intermediate heat exchanger 15*b* turns into a low-temperature low-pressure gas refrigerant while cooling the heat medium as a heat exchange object and flows out. The gas refrigerant having flowed out from the intermediate heat exchanger 15*b* passes through the expansion valve 16*c* to flow out from the relay unit 3. And it passes through refrigerant pipeline 4 to flow into the outdoor unit 1. Here, the relay unit side controller 300 performs control (superheat control) of the opening-degree of the expansion valve 16*a* to make the temperature difference between the inlet (flow-in) side and the outlet (flow-out) side of the intermediate heat exchanger 15*b* to approach a control target value. The expansion valve 16*b* is made to have an opening-degree such that no refrigerant flows based on instructions from the relay unit side controller 300. The expansion valve 16*c* is made to be full open based on the instructions from the relay unit side controller 300 so that no pressure loss is generated.

The refrigerant having flowed into the outdoor unit 1 passes through the check valve 13*d* to be sucked into the compressor 10 again via the four-way valve 11 and the accumulator 17.

Next, descriptions will be given to the heat medium flow in the heat medium circulation circuit. Here, in FIG. 6, it is not necessary to make the heat medium to pass through the use side heat exchanger 26*c* and 26*d* of the indoor units 2*c* and 2*d* subjected to no air-conditioning load because of stop. (The indoor space 7 needn't be cooled or heated. A state of being thermo-off is included.) Then, based on the instructions from the relay unit side controller 300, the stop valves 24*c* and 24*d* are closed so that no heat medium flows into the use side heat exchangers 26*c* and 26*d*.

The heat medium is cooled by the heat exchange with the refrigerant in the intermediate heat exchanger 15*b*. Then, the cooled heat medium is sucked by the pump 21*b* to be sent out. In the meantime, the heat medium is heated by the heat exchange with the refrigerant in the intermediate heat exchanger 15*a*. Then, the heated heat medium is sucked by the pump 21*a* to be sent out.

The cooled heat medium flowed out from the pump 21*b* passes through the flow path switching valve 22*b* and the stop valve 24*b*. The heated heat medium flowed out from the pump 21*a* passes through the flow path switching valve 22*a* and the stop valve 24*a*. Thus, the flow path switching valve 22*a* allows heated heat medium to pass and cooled heat medium to be shut off. The flow path switching valve 22*b* allows cooled heat medium to pass and heated heat medium to be shut off. Therefore, in the circulation, cooled heat medium and heated heat medium are separated, being never mixed.

Through flow amount adjustment by the flow amount adjustment valves 25*a* and 25*b* based on the instructions from the relay unit side controller 300, the heat medium that covers (supplies) the necessary heat amount for the air-conditioning load to cool the air in the indoor space 7 flows into the use side heat exchangers 26*a* and 26*b*. Here, the relay unit side controller 300 makes the flow amount adjustment valves 25*a* and 25*b* to adjust the ratio of the heat medium passing through the use side heat exchangers 26*a* and 26*b* and the heat medium bypass pipelines 27*a* and 27*b* so that the temperature differences between the temperatures related to the detection by the third temperature sensors 33*a* and 33*b* and the temperatures related to the detection by the fourth temperature sensors 34*a* and 34*b* are made to be a set target value respectively.

The heat medium flowed into the use side heat exchangers 26*a* and 26*b* exchanges heat with the air in the indoor space 7 and flows out. On the other hand, the remaining heat medium that has not flowed into the use side heat exchangers 26*a* and 26*b* pass through the heat medium bypass pipelines 27*a* and 27*b* with no contribution to air-conditioning of the indoor space 7.

The heat medium having flowed out of the use side heat exchangers 26*a* and 26*b* and the heat medium having passed through the heat medium bypass pipelines 27*a* and 27*b* meet at the flow amount adjustment valves 25*a* and 25*b* and pass through the flow path switching valves 23*a* and 23*b* to flow into the intermediate heat exchanger 15*b*. The heat medium cooled in the intermediate heat exchanger 15*b* is sucked by the pump 21*b* again to be sent out. Similarly, the heat medium heated in the intermediate heat exchanger 15*a* is sucked by the pump 21*a* again to be sent out.

Heating-Main Operation

Figure 7:
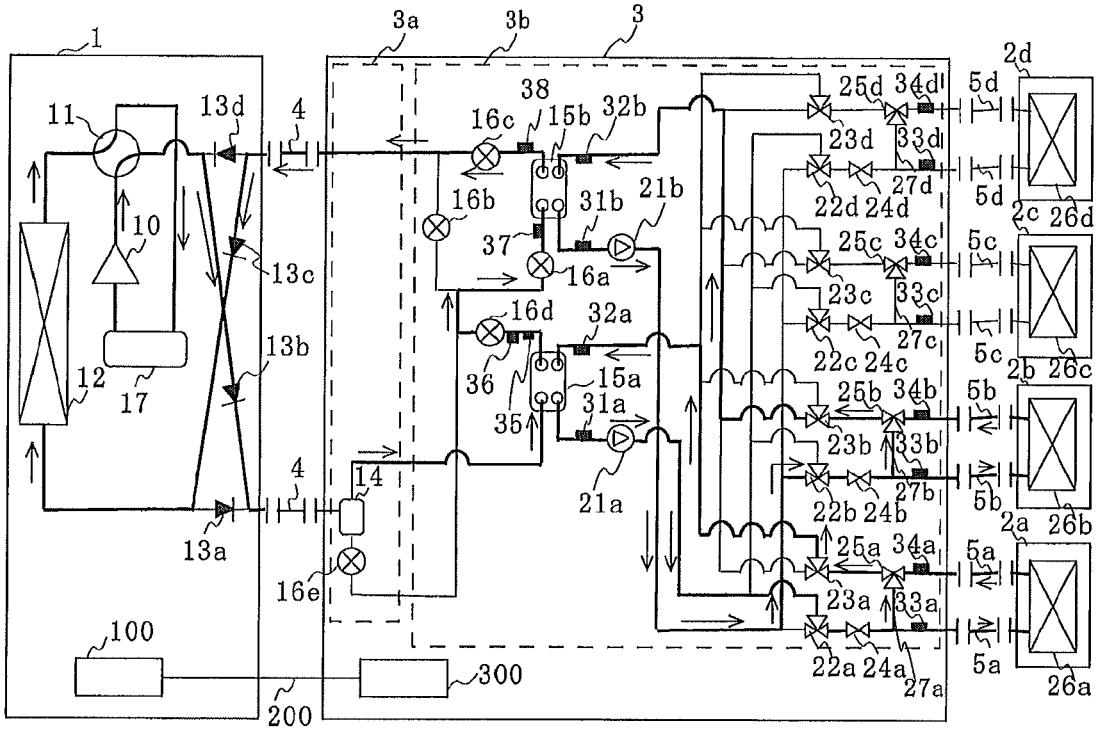
FIG. 7 is a diagram showing the refrigerant and the heat medium flow at the time of heating-main operation.

FIG. 7 is a diagram showing each refrigerant and heat medium flow at the time of heating-main operation. Here, descriptions will be given to a case where the indoor unit 2*a* performs heating, the indoor unit 2*b* performs cooling, and the indoor units 2*c* and 2*d* are stopped. Firstly, the refrigerant flow in the refrigeration cycle will be explained. In the outdoor unit 1, the refrigerant sucked into the compressor 10 is compressed and discharged as a high-temperature gas refrigerant. The refrigerant having flowed out the compressor 10 flows through the four-way valve 11 and the check valve 13*b*. Further it passes through the refrigerant pipeline 4 to flow into the relay unit 3.

The refrigerant having flowed into the relay unit 3 passes through the gas-liquid separator 14. The gas refrigerant having passed through the gas-liquid separator 14 flows into the intermediate heat exchanger 15*a*. The refrigerant having flowed into the intermediate heat exchanger 15*a* turns into the liquid refrigerant while heating the heat medium as a heat exchange object by condensation, flows out there from and passes through the expansion valve 16*d*. Here, the relay unit side controller 300 performs opening-degree control (subcool control) of the expansion valve 16*d* such that the temperature difference between the saturation temperature of the outlet (flow-out) side pressure of the refrigerant in the intermediate heat exchanger 15*a* and outlet side temperature is made to approach a control target value. The expansion valve 16*e* is made to have an opening-degree such that no refrigerant flows.

The refrigerant having passed the expansion valve 16*d* further passes through the expansion valves 16*a* and 16*b*. The low-temperature low-pressure gas-liquid two-phase refrigerant having passed through the expansion valve 16*a* flows into the intermediate heat exchanger 15*b*. The refrigerant having flowed into the intermediate heat exchanger 15*b* turns into a low-temperature low-pressure gas refrigerant while cooling the heat medium as a heat exchange object by evaporation and flows out. The gas refrigerant having flowed out from the intermediate heat exchanger 15*b* passes through the expansion valve 16*c*. On the other hand, the refrigerant having passed the expansion valve 16*b* turns into a low-temperature low-pressure gas-liquid two-phase refrigerant as well because the relay unit side controller 300 controls the opening-degree of the expansion valve 16*a*, and meets with the gas refrigerant having passed the expansion valve 16*c*. Therefore, the refrigerant becomes a low-temperature low-pressure refrigerant having larger dryness. The met refrigerant flows into the outdoor unit 1 via the refrigerant pipeline 4. Here, the relay unit side controller 300 performs control (superheat control) of the opening-degree of the expansion valve 16*a* to make the temperature difference between the inlet (flow-in) side and the outlet (flow-out) side of the refrigerant in the intermediate heat exchanger 15*b* approach a control target value. The controller also controls the opening-degree of the expansion valve 16*b* to make the pressure difference between the pressure in the gas-liquid separator 14 and the medium pressure to approach a target value. Further, the controller also controls the opening-degree of the expansion valve 16*c* to make the refrigerant temperature at the inlet side of the intermediate heat exchanger 15*b* not to be a predetermined temperature or less in order to prevent the heat medium from freezing and the like.

The refrigerant flowed into the outdoor unit 1 flows into the heat source side heat exchanger 12 that functions as an evaporator, via the check valve 13*c*. The low-temperature low-pressure gas-liquid two-phase refrigerant evaporates through heat exchange with the air while passing through the heat source side heat exchanger 12 and turns into a low-temperature low-pressure gas refrigerant. The refrigerant having flowed out the heat source side heat exchanger 12 is sucked into the compressor 10 again through the four-way valve 11 and the accumulator 17.

Next, descriptions will be given to the heat medium flow in the heat medium circulation circuit. Here, in FIG. 7, there is no need to make the heat medium to pass through the use side heat exchangers 26*c* and 26*d* of the indoor units 2*c* and 2*d* to which no air-conditioning load is imposed because of the stop. (The indoor space 7 needn't be cooled or heated. A state of thermo-off is included. Therefore, the stop valves 24*c* and 24*d* are closed based on instructions from the relay unit side controller 300 so that no heat medium flows in the use side heat exchangers 26*c* and 26*d*.

The heat medium is cooled by heat exchange with the refrigerant in the intermediate heat exchanger 15*b*. The cooled heat medium is sucked by the pump 21*b* to be sent out. In the meantime, the heat medium is heated by heat exchange with the refrigerant in the intermediate heat exchanger 15*a*. The heated heat medium is sucked by the pump 21*a* to be sent out.

The cooled heat medium having flowed out from the pump 21*b* passes through the flow path switching valve 22*b* and the stop valve 24*b*. The heated heat medium having flowed out from the pump 21*a* passes through the flow path switching valve 22*a* and the stop valve 24*a*. Thus, the flow path switching valve 22*a* makes heated heat medium pass and shuts off cooled heat medium. The flow path switching valve 22*b* makes cooled heat medium pass and shuts off heated heat medium. Therefore, in the circulation, cooled heat medium and heated heat medium are separated, being never mixed.

Through the flow amount adjustment by the flow amount adjustment valves 25*a* and 25*b* based on the instructions from the relay unit side controller 300, the heat medium that cover (supply) the necessary heat amount for the air-conditioning load to cool the air in the indoor space 7 flows into the use side heat exchangers 26*a* and 26*b*. Here, the relay unit side controller 300 makes the flow amount adjustment valves 25*a* and 25*b* to adjust the ratio of the heat medium passing through the use side heat exchangers 26*a* and 26*b* and the heat medium bypass pipelines 27*a* and 27*b* so that the temperature differences between the temperatures related to the detection by the third temperature sensors 33*a* and 33*b* and the temperatures related to the detection by the fourth temperature sensors 34*a* and 34*b* are made to be a set target value.

The heat medium flowed into the use side heat exchangers 26*a* and 26*b* exchanges heat with the air in the indoor space 7 and flows out. On the other hand, the remaining heat medium that has not flowed into the use side heat exchangers 26*a* and 26*b* pass through the heat medium bypass pipelines 27*a* and 27*b* with no contribution to air-conditioning of the indoor space 7.

The heat medium having flowed out of the use side heat exchangers 26*a* and 26*b* and the heat medium passed through the heat medium bypass pipelines 27*a* and 27*b* meet at the flow amount adjustment valves 25*a* and 25*b* and pass through the flow path switching valves 23*a* and 23*b* to flow into the intermediate heat exchanger 15*b*. The heat medium cooled in the intermediate heat exchanger 15*b* is sucked by the pump 21*b* again to be sent out. Similarly, the heat medium heated in the intermediate heat exchanger 15*a* is sucked by the pump 21*a* again to be sent out.

Next, there is a case where all the heat medium flows to the use side heat exchangers 26*a* to 26*d* side without passing through the heat medium bypass pipelines 27*a* to 27*d* and the rotation speed of the pumps 21*a* and 21*b* are maximum.

Under such a state, a case is considered where the air-conditioning load applied to the use side heat exchangers 26*a* to 26*d* by cooling due to a fierce heat wave or applied to the use side heat exchangers 26*a* to 26*d* by heating due to a bitter cold wave is further increased, and heat amount has to be supplied that can cope with the air-conditioning load applied to the use side heat exchangers 26*a* to 26*d*. In such a case, it is often difficult for only apparatuses on the heat medium circulation circuit side to supply heat amount further. Transportation of the heat medium increases carrying power and consumes energy.

Here, in the intermediate heat exchanger 15*a* that heats the heat medium, the refrigerant releases heat to the heat medium to heat it. Therefore, the outlet side (flow-out side) temperature of the heat medium related to the detection by the first temperature sensor 31*a* does not become higher than the refrigerant temperature at the inlet side (flow-in side) of the intermediate heat exchanger 15*a*. Since heating amount is small in the superheat gas area of the refrigerant, the outlet side (flow-out side) temperature of the heat medium is restricted by a condensing temperature obtained by a saturation temperature at a pressure related to the detection by the pressure sensor 36. In the intermediate heat exchanger 15*b* that cools the heat medium, the refrigerant absorbs heat from the heat medium to cool it. Therefore, the outlet side (flow-out side) temperature of the heat medium related to the detection by the first temperature sensor 31*b* does not become lower than the refrigerant temperature at the inlet side (flow-in side) of the intermediate heat exchanger 15*b*.

Accordingly, in response to the increase or decrease in the air-conditioning load caused by heating or cooling of the use side heat exchangers 26*a* to 26*d* (indoor units 2*a* to 2*d*), the evaporating temperature of the refrigerant in the intermediate heat exchanger 15*b* and the condensing temperature of the refrigerant in the intermediate heat exchanger 15*a* are adapted to be increased or decreased respectively. Thus, the temperature of the heat medium related to heating or cooling is increased or decreased and the heat medium is made to be sent out to the use side heat exchangers 26*a* to 26*d*. Then, according to the air-conditioning load of the use side heat exchangers 26*a* to 26*d*, a control target value of the condensing temperature and/or the evaporating temperature of the refrigerant in the intermediate heat exchangers 15*a* and 15*b* is changed. The controller that controls each apparatus of the refrigeration cycle controls the condensing temperature and/or the evaporating temperature to be changed to the control target value. It is possible to follow the change in the air-conditioning load by changing the condensing temperature and/or the evaporating temperature.

To the contrary, a case is considered where the air-conditioning load is small. For example, when the air-conditioning load of the heat exchangers 26*a* to 26*d* by cooling is small, 7 degrees C. of the heat medium outlet side temperature of the use side heat exchangers 26*a* to 26*d* is too low. Then, by increasing the evaporating temperature of the refrigerant passing through the intermediate heat exchanger 15*b*, the outlet side temperature of the heat medium is made higher. For example, a control target value is changed so that the evaporating temperature, which is usually 0 degree C., becomes 5 degrees C., and the temperature of the heat medium for cooling is made high. Thereby, heat loss in piping is reduced and work amount for the refrigeration cycle to cool the heat medium can be reduced, achieving energy-saving. It is the same in the case where the air-conditioning load of the heat exchangers 26*a* to 26*d* by heating is small. When the air-conditioning load for heating is small, by changing the control target value so as to decrease the condensing temperature, energy-saving can be achieved.

In order to make it possible to set a control target value based on the air-conditioning load, the outdoor unit side controller 100 and the relay unit side controller 300 are connected with a signal line 200 to permit transmission and reception of signals. The relay unit side controller 300 judges the air-conditioning load of heat exchanger 26*a* to 26*d* by heating or cooling and transmits signals including control target value data of the condensing temperature and/or evaporating temperature based on the judgment. The outdoor unit side controller 100 that has received signals changes the control target value of the condensing temperature and/or the evaporating temperature. Here, by transmitting signals including adjustment values data of control target value from the relay unit side controller 300, the outdoor unit side controller 100 may change the control target value.

Figure 8:
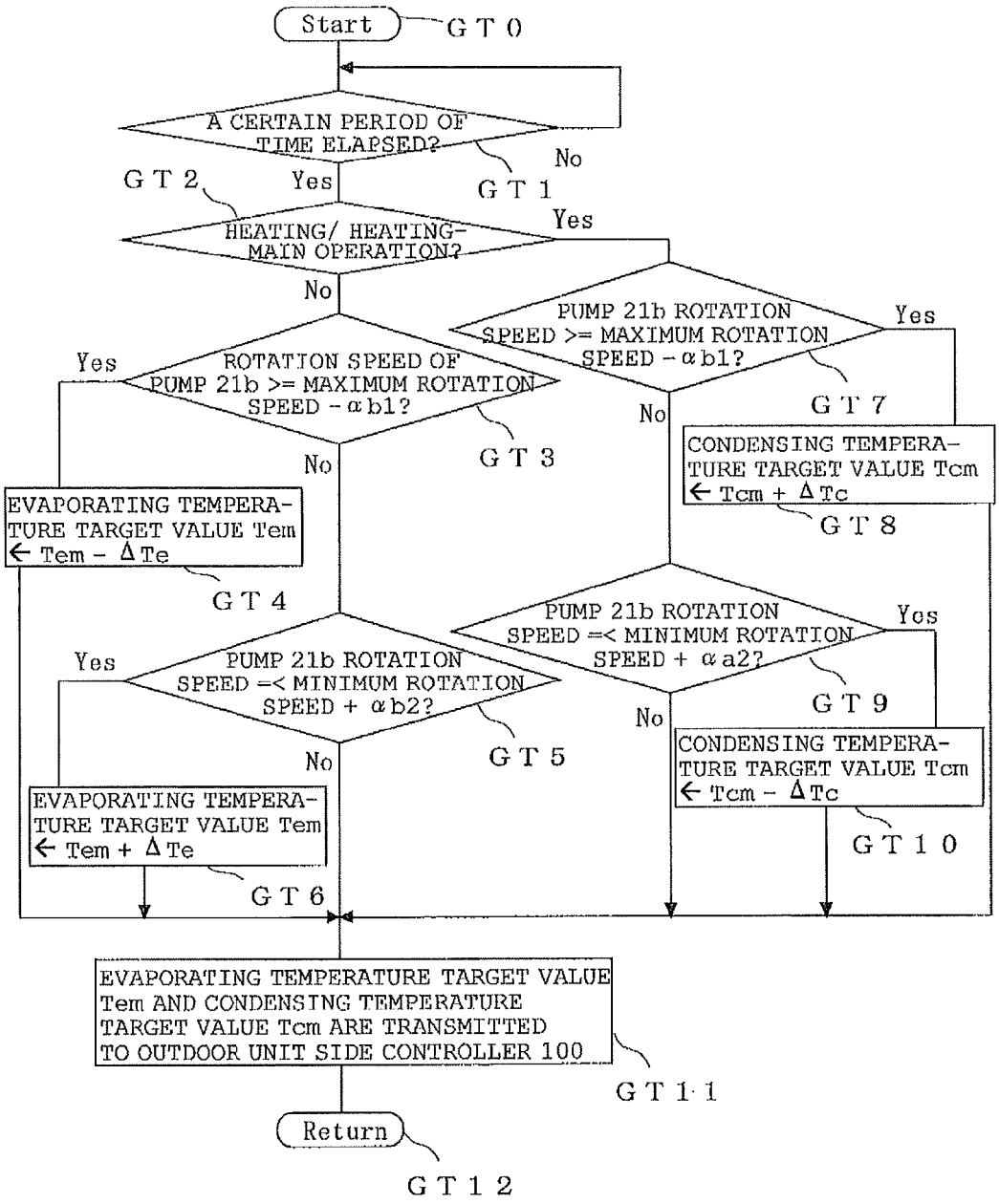
FIG. 8 is a diagram showing the processing related to setting change of a control target value of Embodiment 1.

FIG. 8 is a drawing showing a flow chart of the processing related to change of setting of the control target value of the condensing temperature and evaporating temperature performed by the relay unit side controller 300. Here, descriptions will be given assuming that the relay unit side controller 300 performs optimal flow amount control of the flow amount adjustment valves 25*a* to 25*d*.

After the start of processing (GT0), the relay unit side controller 300 waits for a certain time period until output of each apparatus has been stabilized, for example (GT1). The relay unit side controller 300 judges whether an operation form in the refrigeration cycle is cooling only operation or cooling-main operation having heavy emphasis on cooling (GT2). When being judged that the operation form is cooling only operation or cooling-main operation having heavy emphasis on cooling, the relay unit side controller 300 judges the rotation speed R1 of the pump 21*b* for delivering the heat medium for cooling and whether the rotation speed R1 is equal to or larger than the value obtained by subtracting αb1 from the maximum rotation speed (GT3). Here, αb1 is 10 rpm as a value, for example. When being judged that the rotation speed R1 is equal to or larger than the value obtained by subtracting αb1 from the maximum rotation speed, it can be judged that the rotation speed R1 is too large to cover the cooling air-conditioning load of the use side heat exchangers 26*a* to 26*d* only by the pump 21*b* and the evaporating temperature of the refrigerant is too high to cover the air-conditioning load by cooling. Then, a new control target value of the evaporating temperature Tem is set that is a value obtained by decreasing the current control target value Tem of the evaporating temperature by an evaporating temperature change width ΔTe, (for example, 1 degree C.) (GT4). Thereby, the heat medium is further cooled in the intermediate heat exchanger 15*b*.

When being judged that the rotation speed R1 is smaller than a value obtained by subtracting αb1 from the maximum rotation speed, it is further judged whether the rotation speed R1 is equal to or smaller than the value obtained by adding α b2 (10 rpm, for example) to the minimum rotation speed (GT5). When being judged that the rotation speed R1 is equal to or smaller than the value obtained by adding α b2 to the minimum rotation speed, it can be judged that the rotation speed R1 of the pump 21*b* is too small and the refrigerant evaporating temperature is too low for the air-conditioning load of the use side heat exchangers 26*a* to 26*d* by cooling. Therefore, a new control target value Tem of the evaporating temperature is set that is a value obtained by increasing the current control target value Tem of the evaporating temperature by an evaporating temperature change width ΔTe (GT6). Thereby, cooling of the heat medium can be weakened in the intermediate heat exchanger 15*b*. When the rotation speed R1 is smaller than the value obtained by subtracting αb1 from the maximum rotation speed and larger than the value obtained by adding αb2 to the minimum rotation speed, the control target value Tem of the evaporating temperature is set as it is.

On the other hand, in GT2, when it is judged that the operation form is neither cooling only operation nor cooling-main operation (heating only operation or heating-main operation putting heavy emphasis on heating), the relay unit side controller 300 judges the rotation speed R2 of the pump 21*a* for delivering the heat medium for heating and whether or not the rotation speed R2 is equal to or larger than a value obtained by subtracting αa1 (10 rpm, for example) from the maximum rotation speed (GT7). When being judged that the rotation speed R2 is equal to or larger than a value obtained by subtracting αa1 from the maximum rotation speed, it can be judged that the rotation speed R2 is too large to cover the heating air-conditioning load of the use side heat exchangers 26*a* to 26*d* only by the pump 21*a* and the condensing temperature of the refrigerant is too low to cover the air-conditioning load by heating. Then, a new control target value Tcm of the condensing temperature is set that is a value obtained by increasing the current control target value Tom of the condensing temperature by an condensing temperature change width ΔTc (for example, 1 degree C.) (GT8). Thereby, the heat medium is further heated in the intermediate heat exchanger 15*a*.

When being judged that the rotation speed R2 is smaller than a value obtained by subtracting αa1 from the maximum rotation speed, it is further judged whether or not the rotation speed R2 is equal to or smaller than the value obtained by adding αa2 (10 rpm, for example) to the minimum rotation speed (GT9). When being judged that the rotation speed R2 is equal to or smaller than the value obtained by adding αa2 to the minimum rotation speed, it can be judged that the rotation speed R2 of the pump 21*a* is too small and the refrigerant condensing temperature is too high for the air-conditioning load of the use side heat exchangers 26*a* to 26*d* by heating. Therefore, a new control target value Tcm of the condensing temperature is set that is a value obtained by decreasing the current control target value Tcm of the condensing temperature by an condensing temperature change width ΔTc (GT10). Thereby, heating of the heat medium can be weakened in the intermediate heat exchanger 15*a*. When the rotation speed R2 is smaller than the value obtained by subtracting αa1 from the maximum rotation speed and larger than the value obtained by adding αa2 to the minimum rotation speed, the control target value Tcm of the condensing temperature is set as it is.

The relay unit side controller 300 transmits signals including data of the set control target value Tem of the evaporating temperature or control target value Tcm of the condensing temperature to the outdoor unit side controller 100 via the signal line 200 (GT11). The above-mentioned processing is performed repeatedly (GT12).

Here, although the condensing temperature change width ΔTc and the evaporating temperature change width ΔTe are made to be 1 degree C., it is not limited thereto. The condensing temperature change width ΔTc and the evaporating temperature change width ΔTe may be set at a prefixed constant value. Further, an optimal value may be set by performing processing related to learning during operation. In this case, processing to estimate the air-conditioning load can be performed based on the rotation speed of the pumps 21*a* and 21*b*.

As mentioned above, in the air-conditioning apparatus of Embodiment 1, the heat medium circulates in the indoor unit 2 for heating or cooling the air of the indoor space 7 and no refrigerant circulates therein. Therefore, a safe air-conditioning apparatus can be obtained such that, for example, if the refrigerant leaks from piping and the like, the refrigerant can be suppressed from entering the indoor space 7 where people reside. By making the relay unit 3 a separate unit from the outdoor unit 1 and the indoor unit 2, since the distance for carrying the heat medium becomes shorter compared with the case where the heat medium is circulated between the outdoor unit and the indoor unit directly, carrying power can be small, resulting in energy-saving. In the air-conditioning apparatus of the present embodiment, operation can be performed by any of the four forms (modes), cooling only operation, heating only operation, cooling-main operation, and heating-main operation. When performing such operations, the relay unit 3 has the intermediate heat exchangers 15*a* and 15*b* for heating and cooling the heat medium respectively, and the heat medium necessary for heating and the heat medium necessary for cooling can be supplied to the use side heat exchangers 26*a* and 26*b* in need by the flow path switching valves 22*a* to 22*d* and 23*a* to 23*d* such as a two-way switching valve and a three-way switching valve.

Since the relay unit side controller 300 is adapted to change the control target value of the condensing temperature of the refrigerant passing through the intermediate heat exchanger 15*a* to increase or decrease the heat medium temperature according to the condensing temperature to make the heat medium for heating circulate, when judging that the rotation speed of the pump 21*a* approaches an upper limit or a lower limit, the air-conditioning load applied to the use side heat exchangers 26*a* to 26*d* by heating beyond the limit of the heat medium circulation apparatus can be dealt with. In particular, even when the air-conditioning load is small, the heat medium of an excess heat amount can be prevented from being sent out, achieving energy-saving. In the same way, the relay unit side controller 300 is adapted to change the control target value of the evaporating temperature of the refrigerant passing through the intermediate heat exchanger 15*b* when judging that the rotation speed of the pump 21*b* approaches an upper limit or a lower limit, the air-conditioning load applied to the use side heat exchangers 26*a* to 26*d* by cooling beyond the limit of the heat medium circulation apparatus side can be dealt with.

Embodiment 2

Figure 9:
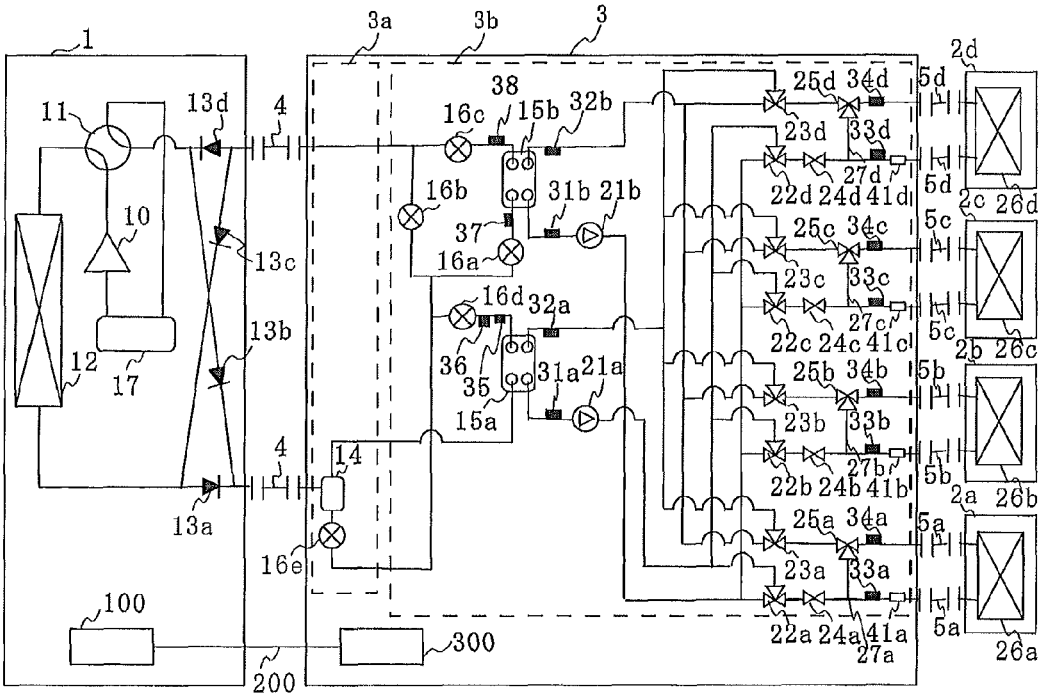
FIG. 9 is a diagram showing the configuration of an air-conditioning apparatus according to Embodiment 2.

FIG. 9 is a diagram showing the configuration of the air-conditioning apparatus according to Embodiment 2. In FIG. 9, the flow amount meters 41*a*, 41*b*, 41*c*, and 41*d* detect the heat medium flow amount flowing through the use side heat exchangers 26*a* to 26*d* respectively to transmit the signal of the flow amount to the relay unit side controller 300.

In the present embodiment, by providing the flow amount meters 41*a*, 41*b*, 41*c*, and 41*d*, the relay unit side controller 300 can obtain the flow amount of the heat medium flowing through the use side heat exchangers 26*a* to 26*d*. Based on the flow amount of the heat medium flowing through the use side heat exchangers 26*a* to 26*d*, the detected temperature by the third temperature sensors 33*a* to 33*d*, and the detected temperature by the fourth temperature sensors 34*a* to 34*d*, the relay unit side controller 300 performs calculation.

For example, it is judged whether the sum total of the air-conditioning load of the use side heat exchangers 26*a* to 26*d* by the cooling and heating in the indoor unit 2 is larger or smaller than the cooling capacity or heating capacity exhibited in the refrigeration cycle apparatus. Then, the relay unit side controller 300 controls devices of the refrigeration cycle apparatus, and the cooling capacity or heating capacity is made increased or decreased through instructions to decrease or increase the condensing temperature and the evaporating temperature.

Figure 10:
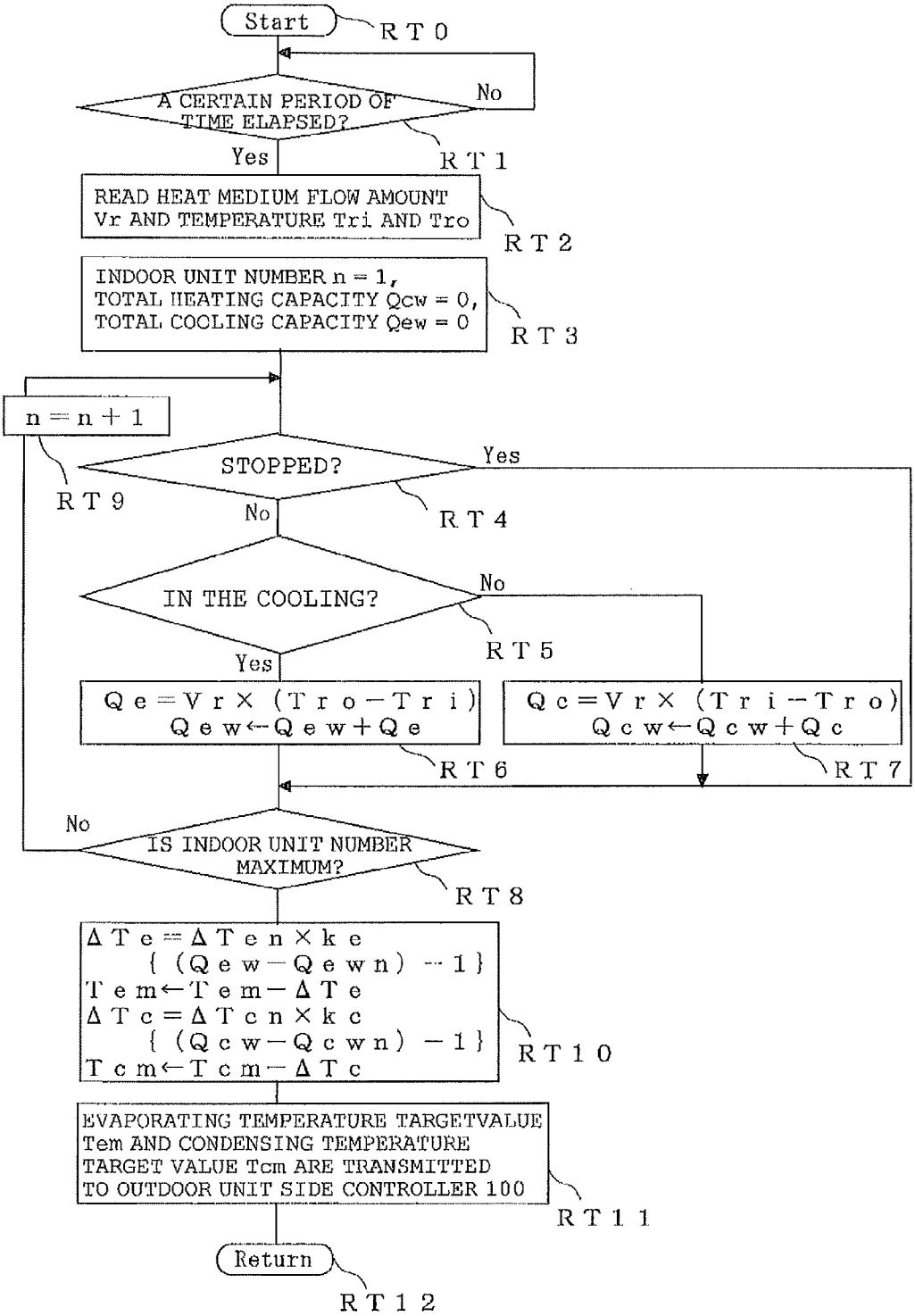
FIG. 10 is a diagram showing the processing related to setting change of control target value of Embodiment 2.

FIG. 10 is a diagram showing a flow chart of the processing related to setting change of the control target value of the condensing temperature and the evaporating temperature performed by the relay unit side controller 300 according to Embodiment 2. Here, in the present embodiment, as indoor unit numbers representing the indoor units 2*a* to 2*d*, indoor unit numbers=1 to 4 are set.

After the start of processing (RT0), the relay unit side controller 300 waits for a certain time period until output of each apparatus has been stabilized, for example (RT1). The relay unit side controller 300 judges (reads) each flow amount Vr of the heat medium detected by the flow amount meters 41*a* to 41*d*, each temperature Tri detected by the third temperature sensors 33*a* to 33*d*, and each temperature Tro detected by the fourth temperature sensors 34*a* to 34*d*, based on the transmitted signal (RT2). Then, indoor unit number n=1, total cooling capacity Qew=0, and total heating capacity Qcw=0 are set as an initial value (RT3). Here, the total cooling capacity Qew is the total value of capacity of the refrigeration cycle apparatus side that cools the heat medium in the intermediate heat exchanger 15*b* according to the air-conditioning load for the heat exchangers 26*a* to 26*d* by cooling. The total heating capacity Qcw is the total value of capacity of the refrigeration cycle apparatus side that heats the heat medium in the intermediate heat exchanger 15*a* according to the air-conditioning load for the heat exchangers 26*a* to 26*d* by heating.

Then, it is judged whether the indoor unit 2*a*, whose indoor unit number is 1, is stopped or not, for example (RT4). When it is judged that the indoor unit 2*a* is not stopped, it is further judged whether the indoor unit 2*a* performs cooling or not (RT5). When it is judged that the indoor unit 2*a* performs cooling, cooling capacity Qe in the indoor unit 2*a* (=air-conditioning load applied to the use side heat exchanger 26*a* to 26*d* by cooling in the indoor unit 2) is calculated according to the following formula (1). The calculated cooling capacity Qe is added to the total cooling capacity Qew (RT6). On the other hand, when it is judged that cooling is not performed (heating is performed), heating capacity Qc in the indoor unit 2*a* (=air-conditioning load of the use side heat exchanger 26*a* to 26*d* by heating in the indoor unit 2) is calculated according to the following formula (2). The calculated heating capacity Qc is added to the total heating capacity Qcw (RT7). Here, when it is judged that the indoor unit 2 is stopped at RT4, cooling capacity Qe and heating capacity Qc are not calculated.

$$Qe=Vr\times(Tro-Tri)$$

$$Qew\leftarrow Qew+Qe \tag{1}$$

$$Qc=Vr\times(Tri-Tro)$$

$$Qcw\leftarrow Qcw+Qc \tag{2}$$

Then, it is judged whether the indoor, unit number is a set maximum value or not (RT8). When judged not to be the maximum value, 1 is added to the indoor unit number n supposing that an unprocessed indoor unit 2 exists (RT9). Processing at RT4 to RT7 is performed based on data related to the indoor unit 2 represented by the next indoor unit number.

After completing all processing related to the indoor unit 2, calculated total cooling capacity Qew is substituted into formula (3) and an evaporating temperature change amount ΔTe is calculated. Here, a standard cooling capacity Qewn, standard evaporating temperature deviation ΔTen, and coefficient ke are set values. The calculated total heating capacity Qcw is substituted into formula (4) and a condensing temperature change amount ΔTc is calculated. Here, a standard heating capacity Qcwn, standard evaporating temperature deviation ΔTcn, and coefficient kc are set values. The value obtained by reducing the control target value Tem of the evaporating temperature by the evaporating temperature change amount ΔTe based on the formula (5) is set as a new control target value Tem of the evaporating temperature. The value obtained by increasing the control target value Tcm of the condensing temperature by the condensing temperature change amount ΔTc based on the formula (6) is set as a new control target value Tom of the condensing temperature (RT10).

$$\Delta Te=\Delta Ten\times ke\times((Qew/Wewn)-1) \tag{3}$$

$$\Delta Tc=\Delta Tcn\times kc\times((Qcw/Wcwn)-1) \tag{4}$$

$$\Delta Tem=\Delta Tem-\Delta Te \tag{5}$$

$$\Delta Tcm=\Delta Tcm-\Delta Tc \tag{6}$$

The relay unit side controller 300 transmits signals including data of the set control target value Tem of the evaporating temperature or set control target value Tcm of the condensing temperature to the outdoor unit side controller 100 via the signal line 200 (GT10). The above-mentioned processing is performed repeatedly (GT12).

Here, in formula (3), when the total cooling capacity Qew is equal to the standard cooling capacity Qewn, ΔTe becomes 0. In formula (4), when the total heating capacity Qcw is equal to the standard heating capacity Qcwn, ΔTc is adapted to become 0. Therefore, the air-conditioning load amount of the use side heat exchangers 26*a* to 26*d* by cooling and that of by heating are adapted to be reflected to ΔTe and ΔTc, respectively. Thus, air-conditioning load can be estimated based on the flow amount of the detected heat medium.

Here, in FIG. 9, the flow amount meters 41*a* to 41*d* are installed at the inlet side of the use side heat exchangers 26*a* to 26*d*. However, if it is possible to detect the flow amount flowing through the use side heat exchangers 26*a* to 26*d*, the flow amount meters may be disposed at the outlet side of the use side heat exchangers 26*a* to 26*d*.

The flow amount meters 41*a* to 41*d* are arranged to detect the heat medium flow amount flowing through the use side heat exchangers 26*a* to 26*d*. Here, if flow amount adjustment valves 25*a* to 25*d* are stepping motor type flow amount adjustment valves, there is a correlation between the number of pulses for driving the motor and the flow amount. Therefore, by storing the relation between the number of pulses and the flow amount in the storage device, the relay unit side controller 300 can detect the heat medium flow amount flowing through the use side heat exchangers 26*a* to 26*d* by estimation.

Using the flow amount detected by the flow amount meters 41*a* to 41*d*, the control target value Tem of the evaporating temperature and the control target value Tem of the condensing temperature are calculated by cooling capacity, heating capacity and the like. In place of the control target value Tem of the evaporating temperature and the control target value Tcm of the condensing temperature, the relay unit side controller 300 can calculate air-conditioning load of the use side heat exchangers 26*a* to 26*d* by cooling and air-conditioning load of the use side heat exchangers 26*a* to 26*d* by heating, based on the rotation speed of the pumps 21*a* and 21*b* and the temperature difference of the heat medium flowing into/out of the intermediate heat exchangers 15*a* and 15*b*, respectively. Based on these air-conditioning loads, instructions to increase or decrease the evaporating temperature and the condensing temperature can be transmitted to the outdoor unit side controller 100 as well. Here, means for detecting the rotation speed or discharge flow amount of the pumps 21*a* and 21*b* may be installed. Here, since the rotation speed of the pumps 21*a* and 21*b* is controlled by the relay unit side controller 300 and the controller, can perform a role of the detection means as well, no detection means is required in particular.

In the use side heat exchangers 26*a* to 26*d*, a maximum load condition state is not caused, that is, in all the use side heat exchangers 26*a* to 26*d*, the temperature difference between the inlet side and the outlet side of the use side heat exchangers 26*a* to 26*d* respectively does not become larger than the temperature difference between the inlet side and the outlet side of the intermediate heat exchangers 15*a* to 15*b*. That is, setting change of the target value of inlet/outlet temperature difference of the use side heat exchanger is performed based on the condensing temperature and the evaporating temperature of the refrigerant in the intermediate heat exchanger.

As mentioned above, with the air-conditioning apparatus of Embodiment 2, since control target values of the evaporating temperature and condensing temperature are newly set based on each flow amount Vr of the heat medium and cooling capacity and heating capacity calculated based on the temperature difference between the inlet side and outlet side of the heat medium of the use side heat exchangers 26*a* to 26*d* detected by the third temperature sensors 33*a* to 33*d* and the fourth temperature sensors 34*a* to 34*d*, control target values of the evaporating temperature and condensing temperature can be set based on the air-conditioning loads of the use side heat exchangers 26*a* to 26*d* by cooling and the air-conditioning loads of the use side heat exchangers 26*a* to 26*d* by heating in the use side heat exchangers 26*a* to 26*d*. Therefore, it is possible to cope with increase in the air-conditioning load without increasing the conveying power of the pumps 21*a* and 21*b*, permitting energy-saving.

Embodiment 3

Figure 11:
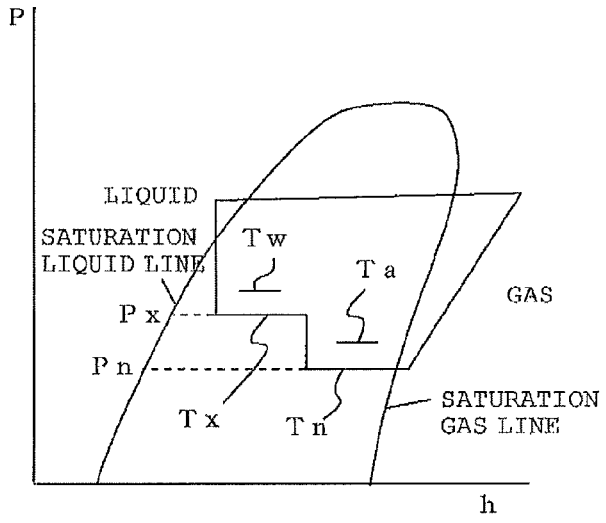
FIG. 11 is a p-h chart according to Embodiment 3.

FIG. 11 is a p-h diagram in the refrigeration cycle at the time of heating-main operation when the air temperature is low according to Embodiment 3. Here, the configuration of the air-conditioning apparatus in the present embodiment is the same as FIGS. 3 and 8 explained in Embodiments 1 and 2. In the present embodiment, operation of the opening-degree of the expansion valve 16*c* based on the control of the relay unit side controller 300 will be explained.

For example, when the air temperature Ta in the outdoor space 6 (hereinafter, an external temperature) is low, the indoor unit 2 often performs heating. There also is an indoor space 7 such as a server room where many computers are installed where cooling is necessary all through the year. In such a case, the above-mentioned heating-main operation is performed. Then, since the heat source side heat exchanger 12 functions as an evaporator, heat is absorbed from the air. In order to absorb heat from the air, the evaporating temperature of the refrigerant in the heat source side heat exchanger 12 has to be lower than the open air temperature.

For example, when the open air temperature is −20 degrees C., the evaporating temperature of the refrigerant in the heat source side heat exchanger 12 becomes approximately −26 degrees C. In this case, without the expansion valve 16*c*, the evaporating temperature of the refrigerant in the heat source side heat exchanger 12 becomes the same as the evaporating temperature of the refrigerant in the intermediate heat exchanger 15*b*. Therefore, if the heat medium in the heat medium circulation circuit is water, for example, the heat medium will be frozen in the intermediate heat exchanger 15*b* and will not circulate. In the case where the heat medium is an anti-freezing liquid, in order to prevent freezing even at the low temperature, the concentration of the anti-freezing liquid has to be high. Accordingly, the viscosity of the heat medium becomes high and the carrying power of the pump 21 is made large, resulting in a large energy consumption amount.

Then, by imposing pressure loss on the refrigerant by the expansion valve 16*c*, the evaporating temperature of the refrigerant in the intermediate heat exchanger 15*b* is made to be kept at a predetermined temperature even when the evaporating temperature of the refrigerant in the heat source side heat exchanger 12 decreases.

As shown by the p-h diagram of FIG. 11, when the open air temperature (the temperature of the air around the heat source side heat exchanger 12) Ta is −20 degrees C., the evaporating temperature Tn of the refrigerant in the heat source side heat exchanger 12 becomes approximately −26 degrees C. Even then, the evaporating temperature Tx of the refrigerant passing through the intermediate heat exchanger 15*b* can be maintained at approximately 0 degree C. At this time, the average temperature Tw of the heat medium in the heat medium circulation circuit becomes about 7 degrees C. Therefore, no heat medium freezes even if it is water. In this case, the difference (Pn−Px) between the saturation pressure Pn of the refrigerant in the heat source side heat exchanger 12 and the saturation pressure Px of the refrigerant in the intermediate heat exchanger 15*b* becomes the pressure loss by the expansion valve 16*c*.

This control is performed by changing the opening-degree of the expansion valve 16*c* through PID (proportional-integral-differential) control, for example, such that the refrigerant outlet (flow-out) side temperature of the intermediate heat exchanger 15*b* detected by the seventh temperature sensor 38 is made to approach a control target temperature.

Figure 12:
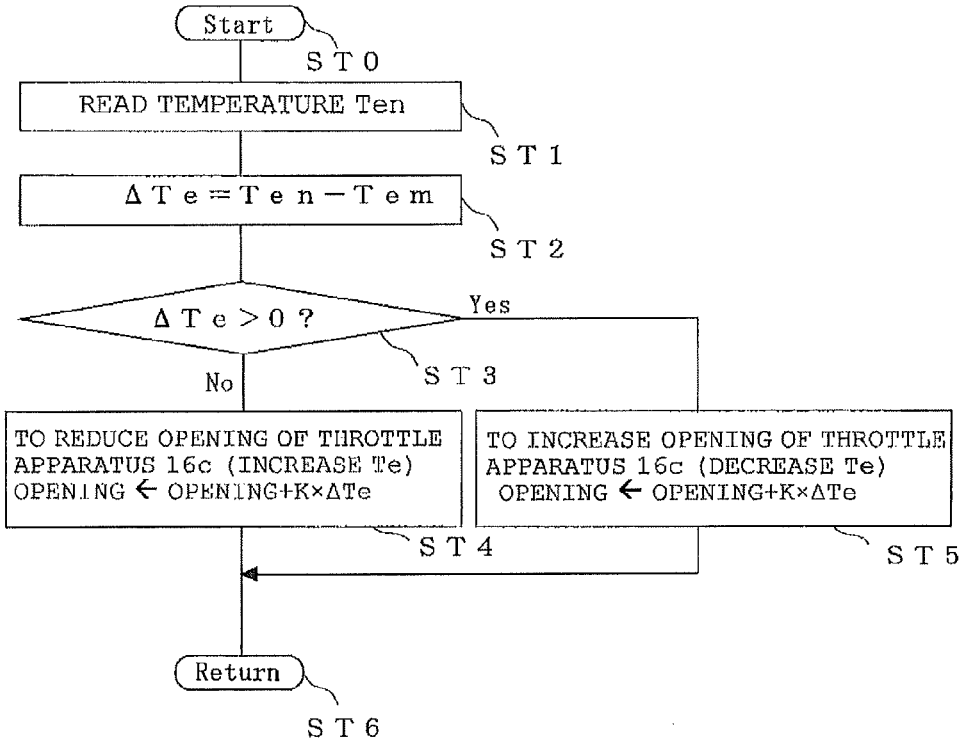
FIG. 12 is a diagram showing processing related to opening-degree control of an expansion valve 16*c*.

FIG. 12 is a diagram showing a flow chart of processing related to opening-degree control of the expansion valve 16*c* performed by the relay unit side controller 300 of Embodiment 3. When the processing is started (ST0), the relay unit side controller 300 judges (reads) the temperature Ten detected by the sixth temperature sensor 37 based on the signal transmitted from the sixth temperature sensor 37 (ST1).

Then, ΔTe is calculated, which is a value obtained by subtracting the control target value Tem of the evaporating temperature from the temperature Ten (ST2). It is judged whether ΔTe is equal to or smaller than 0 (ST3). When it is judged that ΔTe is equal to or smaller than 0 (that is, Ten is lower than the control target value Tem of the evaporating temperature), the expansion valve 16*c* is instructed to reduce the opening-degree (opening area) (ST4). Thus, the inlet side temperature Ten of the refrigerant passing through the intermediate heat exchanger 15*b* is increased. At this time, the opening-degree is corrected by the value obtained by multiplying ΔTe by a proportional constant K, for example. By performing the control related to the correction with the above-mentioned PID control, control precision can be much more improved.

On the other hand, when it is judged that ΔTe is more than 0 (that is, Ten is higher than the control target value Tem of the evaporating temperature), the expansion valve 16*c* is instructed to increase the opening-degree (opening area) (ST5). Thus, the temperature Ten at the inlet side of the refrigerant of the intermediate heat exchanger 15*b* is made to be decreased. The above-mentioned processing is repeated at regular time intervals, for example (ST6).

Here, when the heat medium is water, in order to prevent freezing, the control target value Tem of the evaporating temperature is set at a value higher than 0 degree C., which is the freezing temperature of water. For example, when the control target value Tem of the evaporating temperature is 3 degrees C. and the temperature Tem is 1 degree C., control is performed such that the opening of the expansion valve 16*c* is reduced and the temperature Ten is increased so as to approach the control target value Tem of the evaporating temperature to prevent freezing. When the control target value Tem of the evaporating temperature is 3 degrees C. and the temperature Ten is 5 degrees C., control is performed such that the opening-degree of the expansion valve 16*c* is increased and the temperature Ten is decreased so as to approach the control target value Tem of the evaporating temperature.

When the open air temperature is low and the temperature Ten is higher than the control target value Tem of the evaporating temperature, by increasing the opening-degree of the expansion valve 16*c*, it is possible to control Ten to be the control target value Tem of the evaporating temperature. On the other hand, when the open air temperature is high, even if the opening-degree of the expansion valve 16*c* reaches full open, the temperature Ten remains in a state higher than the control target value Tem of the evaporating temperature. However, in this case, it is efficient for the apparatus as a whole to reduce the pressure loss in the expansion valve 16*c* as much as possible. Therefore, the expansion valve 16*c* is made to remain in the full-open state. Since the opening-degree of the expansion valve 16*c* does not become larger than the full-open, there is no problem with this condition in particular.

The control of evaporating temperature of the refrigerant of the intermediate heat exchanger 15*b* can be performed for other purpose than preventing the freezing of the heat medium. For example, when the air-conditioning load of the use side heat exchangers 26*a* to 26*d* by cooling is small, the evaporating temperature of the refrigerant in the intermediate heat exchanger 15*b* is increased. Thereby, the heat exchange amount in the intermediate heat exchanger 15*b* can be reduced to perform control suitably corresponding to the air-conditioning load, allowing to maintain comfort in the indoor space 7.

As mentioned above, according to the air-conditioning apparatus of Embodiment 3, since the relay unit side controller 300 makes the opening-degree of the expansion valve 16*c* change so that the evaporating temperature of the refrigerant passing through the intermediate heat exchanger 15*b* can be maintained at a temperature equal to or more than a predetermined temperature, a safe operation can be performed without freezing the heat medium due to too low temperature of the refrigerant when the open air temperature is low, for example.

Embodiment 4

In the above-mentioned Embodiment 1, although descriptions are given using a pseudo-azeotropic mixture refrigerant as the refrigerant to be made to circulate in the refrigeration cycle, it is not limited thereto. For example, a single refrigerant such as R-22 and R-134a, a pseudo-azeotropic mixture refrigerant such as R-407C, a refrigerant that is regarded to have a smaller global warming potential such as $CF_3CF{=}CH_2$ including a double bond in the chemical formula and its mixture including said refrigerant, and a natural refrigerant such as $CO_2$ and propane may be employed.

In the air-conditioning apparatus according to the above-mentioned embodiment, the refrigeration cycle is configured to contain an accumulator 17. However, a configuration having no accumulator 17 is possible. Since the check valves 13*a* to 13*d* are not indispensable means, the refrigeration cycle configured without them can perform the same operation and the same working effects can be achieved.

It is not shown in the above-mentioned embodiment in particular, however, for example, a fan may be disposed in the outdoor unit 1 in order to promote heat exchange between the air and the refrigerant in the heat source side heat exchanger 12. In the indoor units 2*a* to 2*d*, a fan may be disposed in order to promote heat exchange between the air and the heat medium in the use side heat exchangers 26*a* to 26*d* to deliver heated or cooled air into the indoor space 7, as well. In the above-mentioned embodiment, descriptions are given to disposing a fan in order to promote heat exchange in the use side heat exchanger 26*a* to 26*d*. However, it is not limited thereto. Any configuration is available as long as it is configured by means, apparatuses and the like that can promote heat release or heat absorption for the refrigerant and heat medium. For example, the use side heat exchangers 26*a* to 26*d* can be configured by a panel heater and the like utilizing radiation without disposing a fan in particular. The heat exchange with the refrigerant in the heat source side heat exchanger 12 may be performed by water and anti-freezing liquid.

In the above-mentioned embodiment, descriptions are given to the case where four indoor units 2 have the use side heat exchanger 26*a* to 26*d* respectively. However, the number of the indoor unit is not limited to four.

Although, descriptions are given to a case where the flow path switching valves 22*a* to 22*d* and 23*a* to 23*d*, the stop valves 24*a* to 24*d*, and the flow amount adjustment valves 25*a* to 25*d* are connected with each use side heat exchanger 26*a* to 26*d* on a one-to-one basis, it is not limited thereto. For example, each use side heat exchanger 26*a* to 26*d* may be connected with a plurality of each apparatus so as to make them operate in the same manner. Then, the flow path switching valves 22 and 23, the stop valves 24, and the flow amount adjustment valves 25 connected with the same use side heat exchangers 26*a* to 26*d* may be made to operate in the same manner.

In the above-mentioned embodiment, descriptions are given to an example where one intermediate heat exchanger 15*a* for cooling the heat refrigerant as an evaporator and one intermediate heat exchanger 15*b* for heating the heat refrigerant as a condenser are provided, respectively. The present invention does not limit the number of each unit to one, but a plurality of units may be provided.

The invention claimed is:

1. An air-conditioning apparatus, comprising:

a refrigeration cycle that connects, a compressor to pressurize a refrigerant, a refrigerant flow path switching apparatus to switch a circulation path of said refrigerant, a heat source side heat exchanger to make said refrigerant exchange heat, a first expansion valve to adjust the pressure of said refrigerant, an intermediate heat exchanger to heat a heat medium different from said refrigerant by exchanging heat between said refrigerant and said heat medium, and an intermediate heat exchanger to cool said heat medium by exchanging heat between said refrigerant and said heat medium, by piping;

a heat medium circulation circuit that connects, said intermediate heat exchanger to heat said heat medium, said intermediate heat exchanger to cool said heat medium, a pump to make said heat medium related to heat exchange of each intermediate heat exchanger circulate, a plurality of use side heat exchangers that exchange heat between said heat medium and the air related to an air-conditioning object space, by piping; and a plurality of heat medium flow path switching apparatuses that select either cooled heat medium or heated heat medium and allow the same to pass through the pipeline connected with an inlet side and an outlet side of said use side heat exchanger, wherein heating of said heat medium by said intermediate heat exchanger to heat said heat medium and cooling of said heat medium by said intermediate heat exchanger to cool said heat medium are simultaneously performed, said heat medium flow path switching apparatuses enable to perform simultaneous cooling and heating operations by making said heated heat medium pass through said use side heat exchanger that performs heating and making said cooled heat medium pass through said use side heat exchanger that performs cooling, said heat source side heat exchanger, said intermediate heat exchanger, and said plurality of use side heat exchangers are formed in separate housings respectively, the air-conditioning apparatus further includes:

an outdoor unit side controller that controls each apparatus in an outdoor unit housing said compressor, said refrigerant flow path switching apparatus and said heat source side heat exchanger, and a relay unit side controller that controls each apparatus in a relay unit housing said first expansion valve and said intermediate heat exchanger and is configured to communicate with said outdoor unit side controller, and wherein the relay unit side controller is configured to transmit a control signal containing data on adjustment values of a control target value of a condensing temperature of the refrigerant passing through the intermediate heat exchanger that heats said heat medium and/or an evaporating temperature of the refrigerant passing through the intermediate heat exchanger that cools said heat medium to said outdoor unit side controller, and said outdoor unit side controller updates a control target value of said condensing temperature and/or evaporating temperature held by said outdoor unit side controller by increasing or decreasing said control target value of said condensing temperature of the refrigerant passing through the intermediate heat exchanger that heats said heat medium and/or an evaporating temperature of the refrigerant passing through the intermediate heat exchanger that cools said heat medium in accordance with the data on adjustment values transmitted by said relay unit side controller to said outdoor unit side controller.

2. The air-conditioning apparatus of claim 1, wherein said first expansion valve is in the inlet side flow path of said intermediate heat exchanger that cools said heat medium, a second expansion valve is installed in a flow path between the intermediate heat exchanger that cools said heat medium when said heat source side heat exchanger functions as an evaporator and said heat source side heat exchanger, and a controller is further provided that controls opening-degree of said second expansion valve so that an evaporating temperature of the refrigerant in the intermediate heat exchanger for cooling said heat medium becomes higher than the evaporating temperature of the refrigerant in said heat source side heat exchanger.

3. The air-conditioning apparatus of claim 2, wherein the evaporating temperature of the refrigerant in the intermediate heat exchanger for cooling said heat medium is made to be a temperature at which said heat medium is not frozen in the intermediate heat exchanger for cooling said heat medium.

4. The air-conditioning apparatus of claim 1, wherein the relay unit side controller judges whether or not the control target value is made to increase or decrease based on the rotation speed of said pump.

* * * * *